US007131716B2

(12) United States Patent
Yamada

(10) Patent No.: US 7,131,716 B2
(45) Date of Patent: Nov. 7, 2006

(54) INK JET PRINTER HEAD AND METHOD OF PRODUCING INK JET PRINTER HEAD

(75) Inventor: Takahiro Yamada, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 181 days.

(21) Appl. No.: 10/806,822

(22) Filed: Mar. 22, 2004

(65) Prior Publication Data

US 2004/0189757 A1 Sep. 30, 2004

(30) Foreign Application Priority Data

Mar. 28, 2003 (JP) ..... 2003-089794

(51) Int. Cl.
*B41J 2/14* (2006.01)

(52) U.S. Cl. ..... 347/47

(58) Field of Classification Search ..... 347/20, 347/29, 40, 44, 47, 87
See application file for complete search history.

(56) References Cited

U.S. PATENT DOCUMENTS 4,994,825 A * 2/1991 Saito et al. ..... 347/63
5,563,641 A * 10/1996 Plesinger ..... 347/47
5,581,288 A * 12/1996 Shimizu et al. ..... 347/87
5,874,971 A * 2/1999 Nishioka et al. ..... 347/20
6,079,810 A * 6/2000 Davis ..... 347/47
6,679,595 B1 * 1/2004 Yamada et al. ..... 347/87
2002/0024568 A1 2/2002 Ito et al.

FOREIGN PATENT DOCUMENTS

JP A-2002-67341 3/2002
JP A-2002-144590 5/2002
JP A-2002-2343144 8/2002

* cited by examiner

*Primary Examiner*—Anh T. N. Vo
(74) *Attorney, Agent, or Firm*—Pitney Hardin LLP

(57) ABSTRACT

An ink jet printer head, including at least one ejector unit having, in one of opposite surfaces thereof, a plurality of nozzles each of which ejects a droplet of ink toward a recording medium, a cover member which has at least one first opening and is fixed to the one surface of the ejector unit such that the nozzles of the ejector unit are exposed through the first opening, a frame member including a bottom wall to which the other surface of the ejector unit is fixed, at least one sealing portion which seals the ejector unit and the cover member to each other along a periphery of the first opening of the cover member, at least one first adhering portion which adheres, and thereby fixes, the cover member to the one surface of the ejector unit, so as to provide a subassembly including the ejector unit and the cover member, and at least one second adhering portion which adheres, and thereby fixes, the subassembly including the ejector unit and the cover member, to the bottom wall of the frame member, such that the other surface of the at least one ejector unit is fixed to the bottom wall of the frame member.

24 Claims, 17 Drawing Sheets

INK JET PRINTER HEAD AND METHOD OF PRODUCING INK JET PRINTER HEAD

BACKGROUND OF THE INVENTION

1. Field of the Invention

The present invention relates to an ink jet printer head including an ejector unit having a plurality of nozzles each of which ejects a droplet of ink toward a recording medium, and a cover member (e.g., a cover plate) which is fixed via a sealing portion (e.g., a sealing agent) to the ejector unit, and also relates to a method of producing an ink jet printer head.

2. Discussion of Related Art

For example, Document 1 (i.e., Japanese Patent Application Publication No. 2002-067341 A1) or Document 2 (i.e., Japanese Patent Application Publication No. 2002-234144 A1) discloses an ink jet printer head including an ejector unit having a plurality of nozzles each of which ejects a droplet of ink toward a recording medium, and a cover plate which is fixed via a sealing agent to the ejector unit.

More specifically described, the ink jet printer head disclosed by each of the above-indicated two publication documents employs a plurality of ejector units each of which has, in an outer surface thereof, a plurality of nozzles arranged in at least one array; a cover plate which has a plurality of openings and covers the ejector units such that the array of nozzles of each of the ejector units is exposed through a corresponding one of the openings; and a frame member supporting the ejector units and the cover plate. The ink jet printer head is assembled in a state in which the array of nozzles of each one of the ejector units is accurately positioned relative to the array of nozzles of the other ejector unit or units. In this state, a sealing agent is provided, between the cover plate and each of the ejector units, along the periphery of a corresponding one of the openings of the cover plate, so that the cover plate covers the respective outer surfaces of the ejector units. Respective opposite surfaces of the ejector units that are opposite to the respective outer surfaces thereof are covered by a bottom wall of the frame member. When an adhesive is charged into through-holes that are formed through the thickness of the bottom wall of the frame member, the ejector units are fixed, with the adhesive, to the bottom wall in the above-indicated state. Simultaneously, the cover plate is fixed, with the adhesive, to the bottom wall of the frame member.

Although, in the above-described ink jet printer head, the ejector units are fixed to the bottom wall of the frame member, with the adhesive charged via the through-holes formed in the bottom wall, the dimensions and positions of the through-holes are more or less limited in view of the structure and strength of the bottom wall, and accordingly the positions where the adhesive is applied are limited. Thus, the adhesive strength of the ejector units cannot be sufficiently increased.

In addition, in a state before the ejector units and the cover plate are finally fixed with the adhesive to the frame member, the ejector units and the cover plate are just temporarily adhered to each other with the sealing agent only. Therefore, the cover plate and each of the ejector units may be displaced relative to each other and accordingly the sealing agent may flow or move. Consequently defects of adhesion, such as bubbles or uneven adhering, and/or defects of sealing, such as gaps or uneven sealing may occur to those portions of the printer head that are sealed by the sealing agent.

SUMMARY OF THE INVENTION

It is therefore an object of the present invention to provide an ink jet printer head, and a method of producing an ink jet printer head, each of which is free from at least one of the above-indicated problems.

It is another object of the present invention to provide an ink jet printer head, and a method of producing an ink jet printer head, each of which can enjoy a high adhesive strength of one or more ejector units.

It is another object of the present invention to provide an ink jet printer head, and a method of producing an ink jet printer head, each of which can prevent defects that may occur to adhesion or sealing between one or more ejector unit or units and a cover member.

According to a first aspect of the present invention, there is provided an ink jet printer head, comprising at least one ejector unit having, in one of opposite surfaces thereof, a plurality of nozzles each of which ejects a droplet of ink toward a recording medium; a cover member which has at least one first opening and is fixed to the one surface of the at least one ejector unit such that the nozzles of the at least one ejector unit are exposed through the at least one first opening; a frame member including a bottom wall to which the other surface of the at least one ejector unit is fixed; at least one sealing portion which seals the at least one ejector unit and the cover member to each other along a periphery of the at least one first opening of the cover member; at least one first adhering portion which adheres, and thereby fixes, the cover member to the one surface of the at least one ejector unit, so as to provide a subassembly including the at least one ejector unit and the cover member; and at least one second adhering portion which adheres, and thereby fixes, the subassembly including the at least one ejector unit and the cover member, to the bottom wall of the frame member, such that the other surface of the at least one ejector unit is fixed to the bottom wall of the frame member.

According to the first aspect of the present invention, the first adhering portion adheres, and thereby fixes, the ejector unit and the cover member to each other. Therefore, the ejector unit and the cover member can be fixed to each other without any restraints resulting from the structure of the bottom wall of the frame member. In addition, the second adhering portion adheres, and thereby fixes, the subassembly including the ejector unit and the cover member, to the bottom wall of the frame member. Thus, the adhesive strength of the ink jet printer head can be improved.

In addition, even in a state before the subassembly including the ejector unit and the cover member is fixed to the bottom wall of the frame member, the ejector unit and the cover member are fixed to each other by the first adhering portion. Therefore, the ejector unit and the cover member can be fixed in position relative to each other, irrespective of to what degree the sealing portion has hardened. Thus, the ink jet printer head is freed of the problem that the ejector unit and the cover member are displaced relative to each other and the sealing portion flows or deforms and accordingly suffers sealing defects such as gaps or uneven sealing.

According to a second aspect of the present invention, there is provided a method of producing an ink jet printer head including at least one ejector unit having, in one of opposite surfaces thereof, a plurality of nozzles each of which ejects a droplet of ink toward a recording medium, a cover member having at least one first opening, and a frame member including a bottom wall, the method comprising the steps of providing, between the at least one ejector unit and the cover member, a sealing agent along a periphery of the at least one first opening of the cover member, such that the at least one ejector unit and the cover member are sealed to each other, and such that the nozzles of the at least one ejector unit are exposed through the at least one first opening of the cover member, adhering and fixing, with a first adhesive, the at least one ejector unit and the cover member to each other, so as to provide a subassembly including the at least one ejector unit and the cover member, and adhering and fixing, with a second adhesive, the subassembly including the at least one ejector unit and the cover member, to the bottom wall of the frame member.

According to the second aspect of the present invention, the ejector unit and the cover member are adhered and fixed to each other with the first adhesive. Therefore, the ejector unit and the cover member can be fixed to each other without any restraints resulting from the structure of the bottom wall of the frame member. In addition, the subassembly including the ejector unit and the cover member is adhered and fixed to the bottom wall of the frame member with the second adhesive. Thus, the adhesive strength of the ink jet printer head can be improved.

In addition, even in a state before the subassembly including the ejector unit and the cover member is fixed to the bottom wall of the frame member with the second adhesive, the ejector unit and the cover member are fixed to each other with the first adhesive. Therefore, the ejector unit and the cover member can be fixed in position relative to each other, irrespective of to what degree the sealing agent provided between those two elements has hardened. Thus, the ink jet printer head is freed of the problem that the ejector unit and the cover member are displaced relative to each other and the sealing agent flows or moves and accordingly suffers sealing defects such as gaps or uneven sealing.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
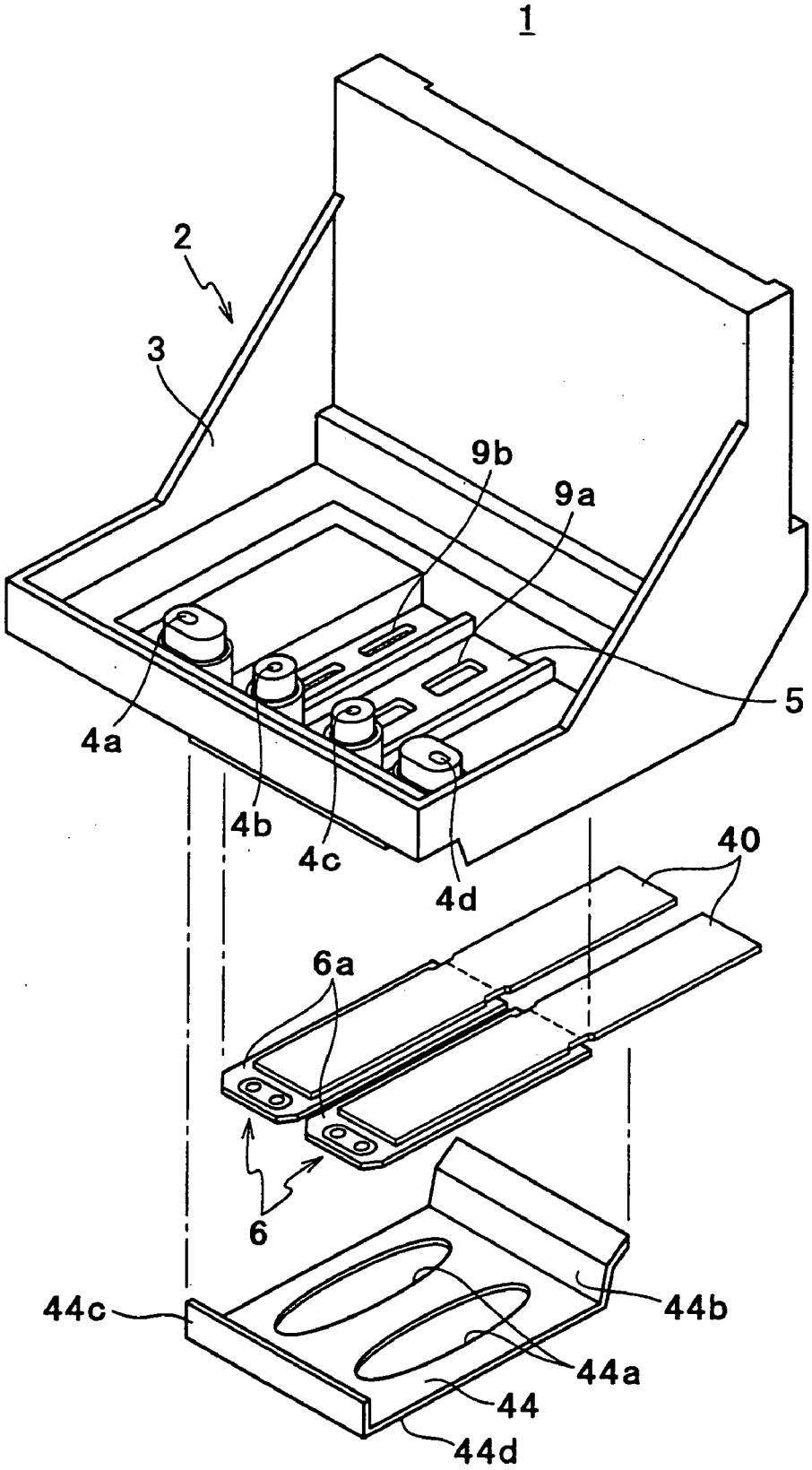
FIG. 1 is an exploded, perspective view of an ink jet printer head to which the present invention is applied.
Figure 6:
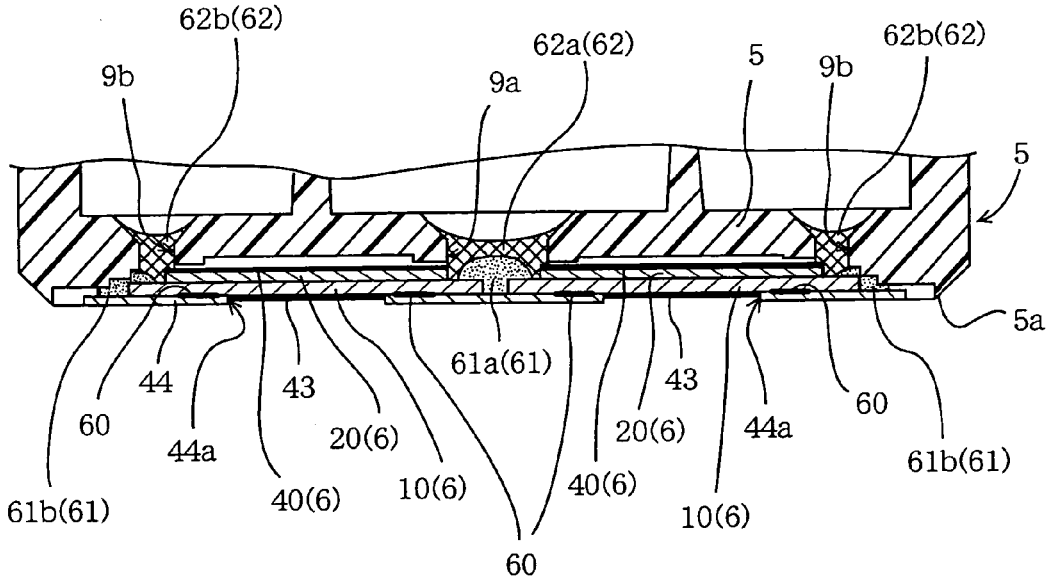
FIG. 6 is a cross-section view of the printer head of FIG. 1, taken along 6—6 in FIG. 4, the printer head being in the assembled state.

Hereinafter, there will be described preferred embodiments of the present invention by reference to the drawings. As shown in FIG. 1, an ink jet printer head 1 as an embodiment of the present invention includes a frame member 2, a plurality of (e.g., two) ejector units 6, a cover plate 44 as a cover member, a plurality of sealing portions 60 (FIG. 6), a plurality of first adhering portions 61 (FIG. 6), and a plurality of second adhering portions 62 (FIG. 6). The frame member 2 is formed, by injection molding, of a synthetic resin such as polyethylene or polypropylene. The two ejector units 6 are provided on a lower surface of the frame member 2, and each of the ejector units 6 has, in an outer or lower surface thereof, a plurality of nozzles 54 which are arranged in two arrays (FIG. 10) and each of which ejects a droplet of ink toward a surface of a recording medium such as a sheet of paper. The cover plate 44 is provided on the respective lower surfaces of the two ejector units 6, and has two first openings 44*a* corresponding to the two ejector units 6, respectively.

The frame member 2 includes a bottom wall 5 to which respective upper surfaces 6*a* of the two ejector units 6 that are opposite to the respective lower surfaces thereof are fixed, and has a generally box-like shape that opens upward. The frame member 2 includes a holder portion 3 to and from which four ink tanks, not shown, each as an ink supply source are attached and detached through the upper opening of the frame member 2. The holder portion 3 has four ink supply passages 4*a*, 4*b*, 4*c*, 4*d* that are formed through the thickness of the bottom wall 5 and are connectable via respective packing members, not shown, to respective outlets of the four ink tanks.

The bottom wall 5 of the frame member 2 has second openings 9*a*, 9*b* into which a second adhesive is injected to form the second adhering portions 62, described later. A first adhesive or the first adhering portions 61 will be described later, too. The second openings 9*a*, 9*b* are formed at respective locations where the second openings 9*a*, 9*b* can be opposed to both the ejector units 6 and the cover plate 44, as shown in FIG. 6. When the second adhesive is injected into the second openings 9*a*, 9*b* opposed to the ejector units 6 and the cover plate 44, a subassembly including the two ejector units 6 and the cover plate 44 is adhered, and fixed, to the lower surface (as seen in FIG. 1) of the bottom wall 5. of the frame member 2. In the present embodiment, the second openings 9*a*, 9*b* are arranged in three arrays that extend parallel to the arrays of nozzles 54 of each of the two ejector units 6, and the middle array of second openings 9*a* are aligned with respective edge portions of the two ejector units 6 that are next to each other, as shown in FIG. 6. The two end arrays of second openings 9*b* (only one end array of second openings 9*b* are shown in FIG. 1) are aligned with respective opposite edge portions of the two ejector units 6 that are opposite to the above-indicated edge portions thereof, respectively, as also shown in the figure. Each array of second openings 9*a*, 9*b* includes two openings that are distant from each other along an edge line or respective edge lines of one or two ejector units 6. However, each array of second openings 9*a*, 9*b* may be replaced with a single, elongate second opening. In either case, each array of second openings 9*a*, 9*b* or each single elongate second opening does not extend over the entire length of the edge line or lines of one or two ejector units 6.

Figure 2:
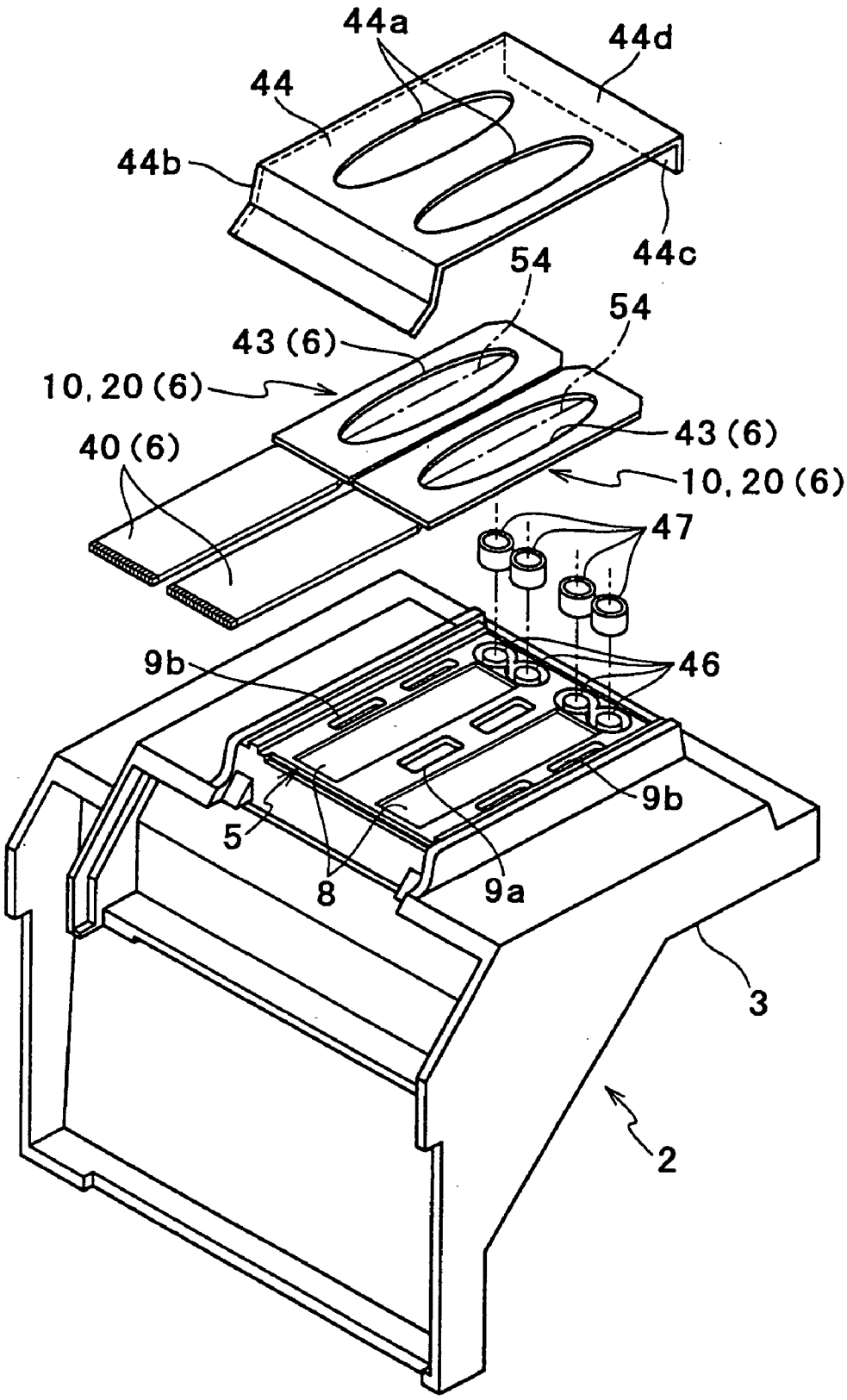
FIG. 2 is an exploded, perspective view of the printer head of FIG. 1, the printer head taking an inverted position.
Figure 3:
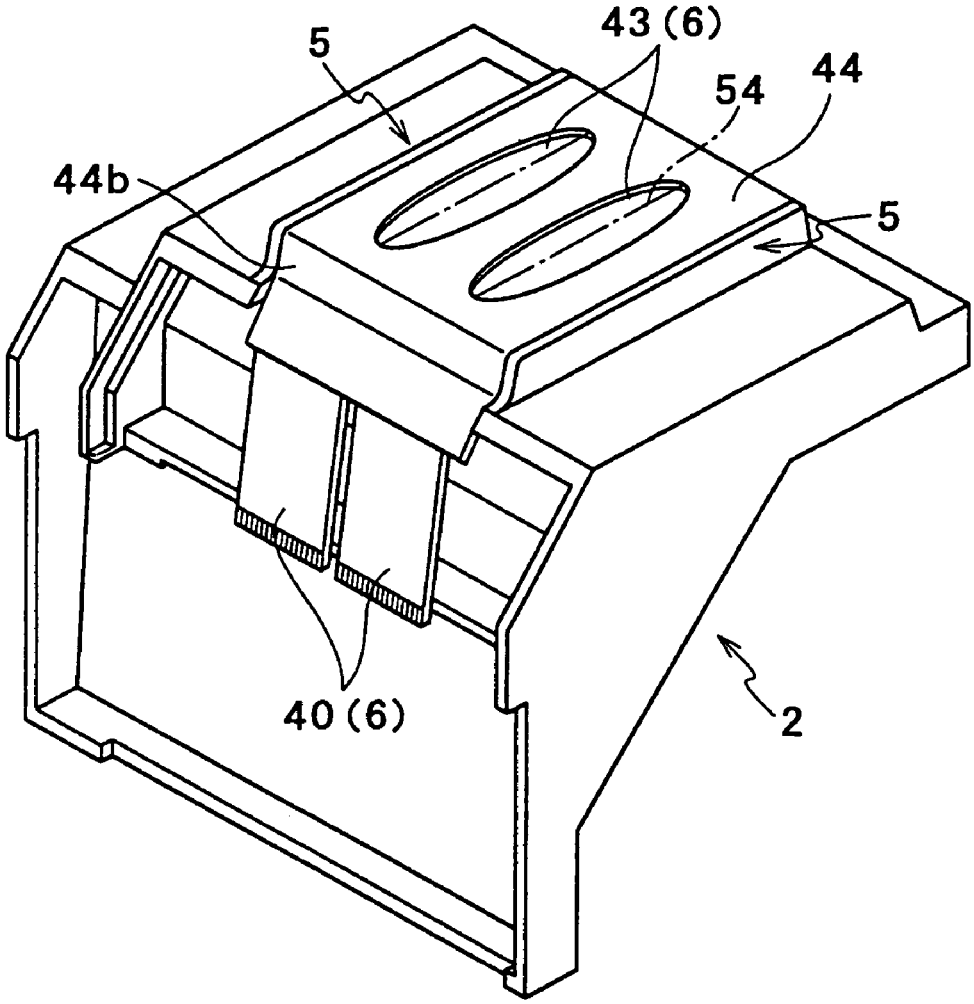
FIG. 3 is a perspective view of the printer head of FIG. 1, the printer head being in an assembled state.
Figure 4:
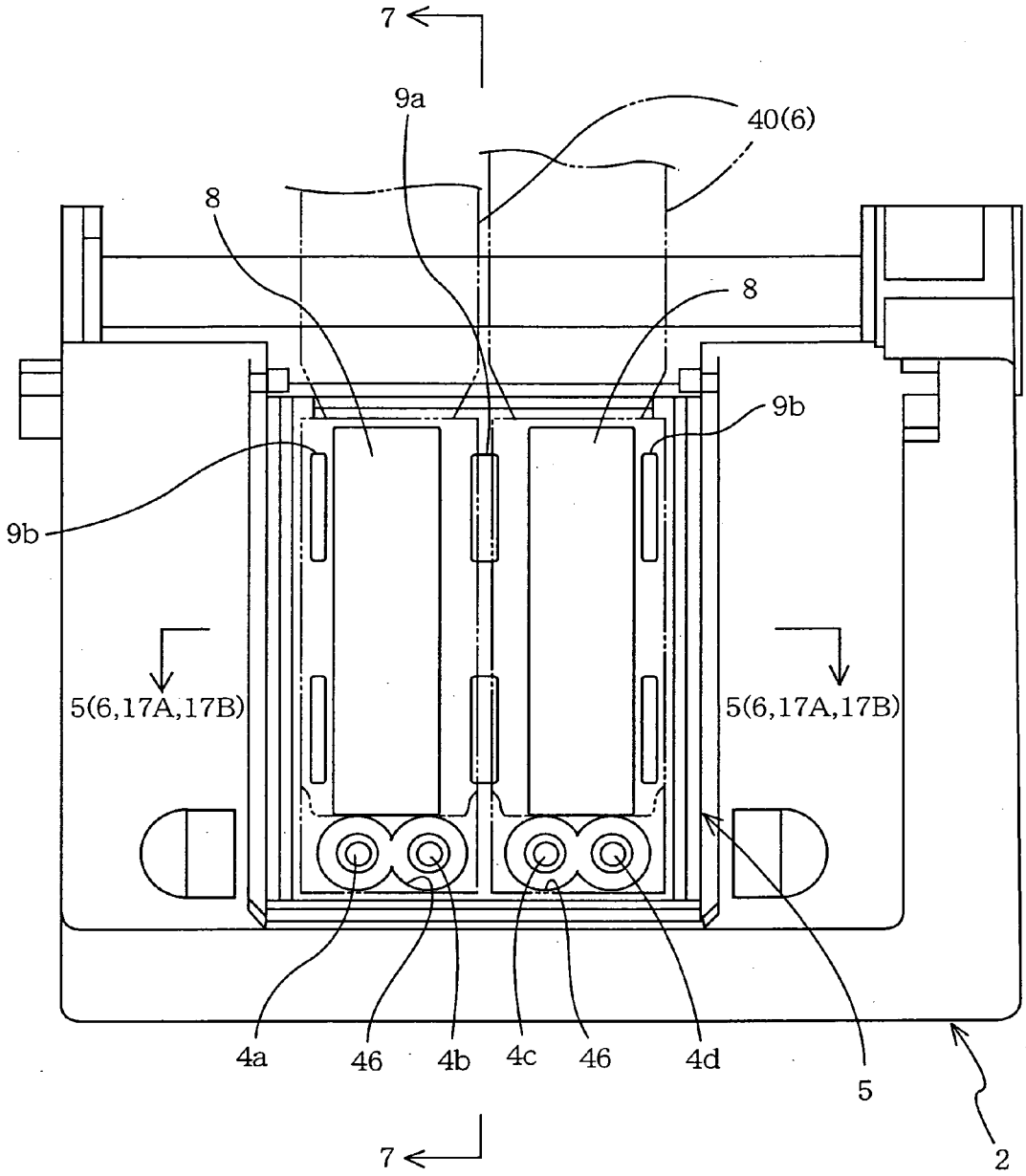
FIG. 4 is a bottom view of a frame member of the printer head of FIG. 1.

As shown in FIG. 2, the bottom wall 5 of the frame member 2 includes two support portions 8 that support the two ejector units 6 such that the two ejector units 6 extend parallel to each other. One of the two support portions 8 is located between the middle array of second openings 9*a* and one of the two end arrays of second openings 9*b*; and the other support portion 8 is located between the middle array of second openings 9*a* and the other end array of second openings 9*b*. Two of the four ink supply passages 4*a*–4*d* open in one of lengthwise opposite end portions of one of the two support portions 8; and the other, two ink supply passages open in one of lengthwise opposite end portions of the other support portion 8. A groove 46 having a generally 8-shaped configuration in its plan view is formed around each of the respective open ends of the four ink supply passages 4*a*–4*d*, and accommodates a ring-like packing member 47 that is formed of, e.g., a soft rubber and exhibits a sealing effect.

Each of the two ejector units 6 includes a nozzle sheet 43, a cavity plate 10, a piezoelectric actuator 20, and a flexible flat cable 40. The nozzle sheet 43 has the plurality of nozzles 54 which are arranged in the two arrays and each of which ejects the droplet of ink toward the recording sheet.

The cover plate 44 is formed of, e.g., a metallic sheet such as a stainless steel sheet, and is provided on the respective lower surfaces of the two ejector units 6 that have the nozzles 54 as shown in FIG. 2. The cover plate 44 protects the nozzles 54, and their vicinities, of the respective nozzle sheets 43 of the two ejector units 6, by preventing the direct contact of the recording sheet with the same 54. In addition, the cover plate 44 prevents the ink from entering the respective electric systems (e.g., the respective piezoelectric actuators 20 and the respective flexible flat cables 40) of the two ejector units 6. Moreover, when a wiper blade, not shown, is used to remove the ink and/or dust that are deposited on the nozzles 54 and their vicinities, the wiper blade is contacted and slid on the cover plate 44. The cover plate 44 includes a nozzle protection portion 44*d*, and two bent portions 44*b*, 44*c* that are bent from the nozzle protection portion 44*d*. The cover plate 44 has a constant thickness that is slightly greater than the thickness of the nozzle sheet 43 of each ejector unit 6.

The cover plate 44 has the two first openings 44*a* that are formed through the thickness of the nozzle protection portion 44*d*, such that the two first openings 44*a* are aligned with the respective nozzle sheets 43 of the two ejector units 6. The number of the first openings 44*a* of the cover plate 44 is equal to that of the ejector units 6 to be fixed to the frame member 2. The two ejector units 6 and the cover plate 44 are adhered and fixed to each other, in a manner described below, such that through each of the first openings 44*a* of the cover plate 44, the nozzles 54 of a corresponding one of the ejector units 6 are exposed to face the recording sheet.

Figure 5:
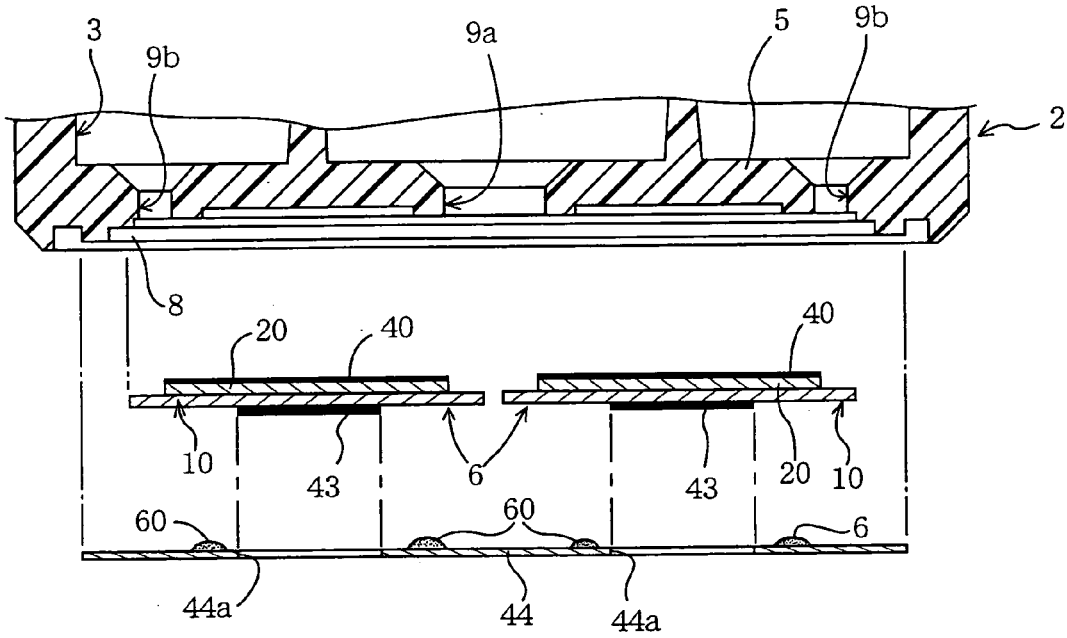
FIG. 5 is a cross-section view of the printer head of FIG. 1, taken along 5—5 in FIG. 4, the printer head being in an exploded state.

As shown in FIG. 5, the cover plate 44 is positioned relative to the two ejector units 6, such that the two first openings 44*a* of the cover plate 44 are. aligned with the respective nozzle sheets 43 of the two ejector units 6. Then, a sealing agent 60 is provided, between the cover plate 44 and the two ejector units 6, along the periphery of each of the two first openings 44*a*, so that the sealing agent 60 exhibits a sealing effect of preventing the ink from penetrating, by capillarity, into gaps that may remain between the ejector units 6 and respective portions of the cover plate 44 that define the first openings 44*a*. The sealing agent 60 is, for example, a silicone adhesive, or a gum adhesive. However, the silicone or gum adhesive may be replaced with a potting agent. In addition, the two ejector units 6 and the cover plate 44 are strongly adhered and fixed to each other by the first adhering portions 61 (61*a*, 61*b*), as shown in FIG. 6.

Figure 8:
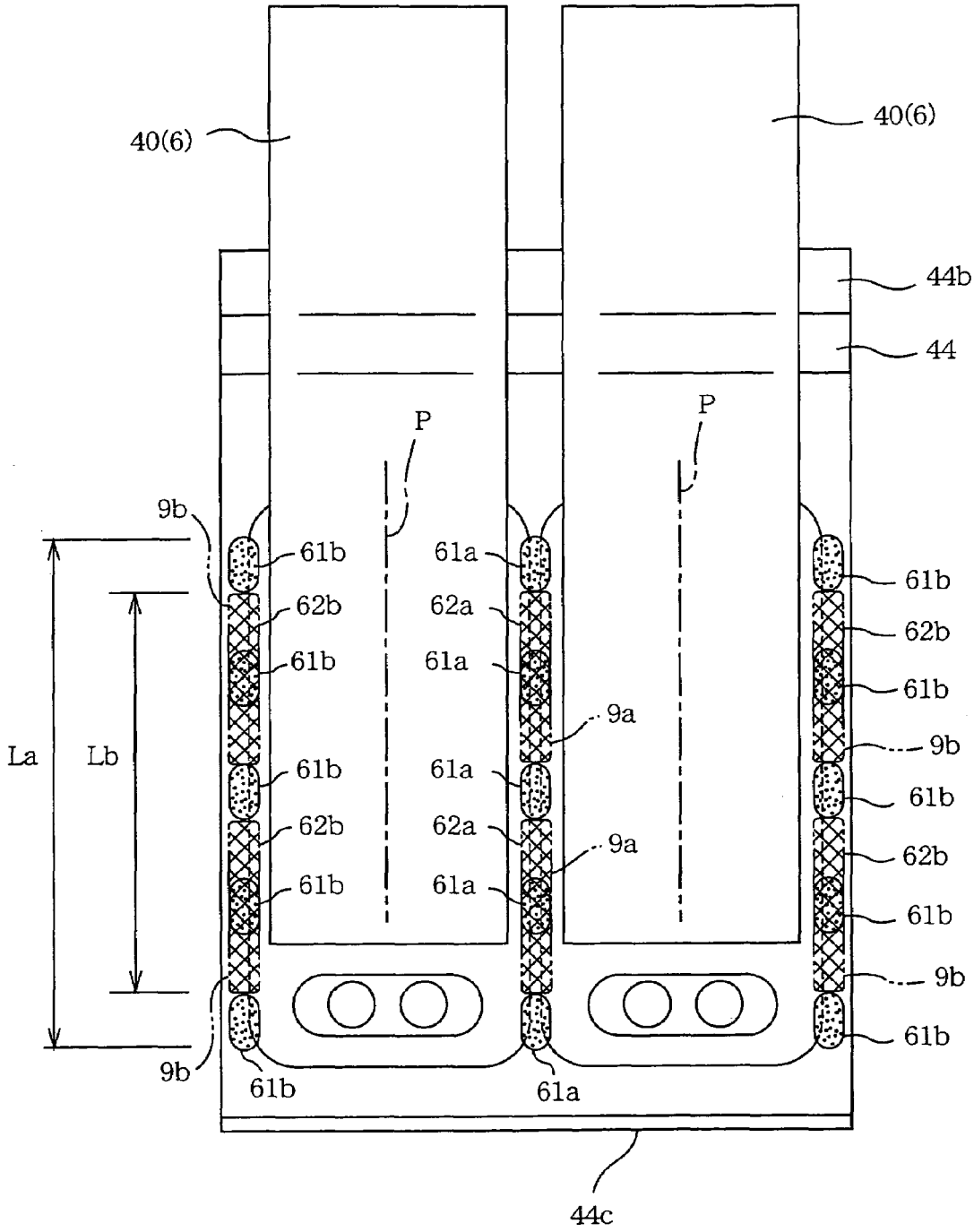
FIG. 8 is a plan view of a subassembly including two ejector units and a cover plate of the printer head of FIG. 1.

The first adhering portions 61 are arranged in three arrays 61*a*, 61*b* that are parallel to the arrays P of nozzles 54, as shown in FIG. 8. The middle array of first adhering portions 61*a* are aligned with the respective edge portions of the two ejector units 6 that are next to each other, as shown in FIG. 6; and the two end arrays of first adhering portions 61*b* are aligned with the respective opposite edge portions of the two ejector units 6 that are opposite to the above-indicated edge portions thereof, respectively. Thus, the first adhering portions 61 adhere and fix, to the cover plate 44, the opposite edge portions of each of the two ejector units 6 that are parallel to the arrays P of nozzles 54. As shown in FIGS. 6 and 8, the middle array of first adhering portions 61*a* are provided below, and along, the middle array of second openings 9*a*; and the two end arrays of first adhering portions 61*b* are provided below, and along, the two end arrays of second openings 9*b*, respectively. In each array of first adhering portions 61*a*, 61*b*, the first adhering portions are arranged at a regular interval of distance along an edge line or respective edge lines of one or two ejector units 6. However, each array of first adhering portions 61*a*, 61*b* may be replaced with a single, continuous first adhering portion. A length, La, (FIG. 8) of each array of first adhering portions 61*a*, 61*b* in a direction parallel to the opposite edge portions of each ejector unit 6 is greater than a length, Lb, of each array of second openings 9*a*, 9*b*. The first adhering portions 61 adhere and fix the plurality of (e.g., two) ejector units 6 to the cover plate 44, such that the arrays of nozzles 54 of each one of the two ejector units 6 are positioned relative to those of the other ejector unit or units 6.

As shown in FIG. 6, the ink jet printer head 1 includes the second adhering portions 62 (62*a*, 62*b*) that adhere and fix the subassembly including the two ejector units 6 and the cover plate 44, to the bottom wall 5 of the frame member 2. The second adhering portions 62*a*, 62*b* are formed of the second adhesive that is injected into the second openings 9*a*, 9*b*. Thus, as seen in the plan view of FIG. 8, the second adhering portions 62*a*, 62*b* are aligned with the second openings 9*a*, 9*b*, respectively, in a direction perpendicular to the bottom wall 5 of the frame member 2. In addition, as shown in FIG. 6, the middle array of second adhering portions 62*a* is superposed on the middle array of first adhering portions 61*a* and thereby integrated with the same 61*a*; and the two end arrays of second adhering portions 62*b* are superposed on the two end arrays of first adhering portions 61*b* and thereby integrated with the same 61*b*, respectively.

Figure 7:
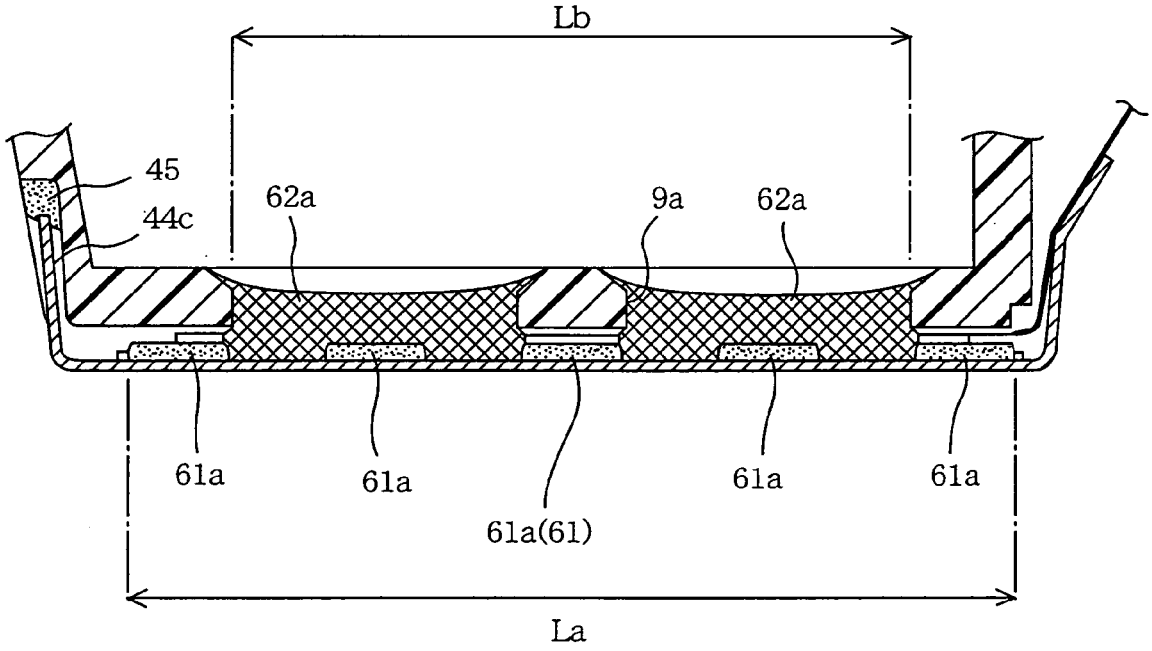
FIG. 7 is a cross-section view of the printer head of FIG. 1, taken along 7—7 in FIG. 4.

The first and second adhering portions 61, 62 may each be formed of an ultraviolet (UV) light sensitive adhesive that is hardened in a short time upon exposure to UV light. In this case, the first and second adhering portions 61, 62 are hardened more quickly than the sealing agent 60, and exhibit a sufficiently high adhesive strength after being hardened. Unlike the UV-light sensitive adhesive, the sealing agent 60 such as the silicone adhesive is not solidified, though the sealing agent 60 exhibits the sealing effect as described above. Small clearances that may remain between the outer periphery of the cover plate 44 and the frame member 2 are sealed with a sealing agent 45 such as a silicone adhesive, as shown in FIG. 7, like in the ink jet printer head disclosed by the previously-identified Document 1.

In the ink jet printer head 1 constructed as described above and shown in, e.g., FIG. 8, the first adhering portions 61 are arranged in the three arrays substantially parallel to the arrays P of nozzles 54, such that in each of the three arrays, the three or more (e.g., five) first adhering portions 61 are arranged at a regular interval of distance on a corresponding one of three straight lines; and the second adhering portions 62 are arranged in the three arrays substantially parallel to the arrays P of nozzles 54, such that in each of the three arrays, the two second adhering portions 62 are distant from each other by a same distance, on a corresponding one of the three straight lines, and overlap the first adhering portions 61 of a corresponding one of the three arrays. Thus, the first and second adhering portions 61, 62 are uniformly distributed and accordingly the ink jet printer head 1 can enjoy a high adhesive strength of each ejector unit 6.

Opposite ends of each of the three arrays of first adhering portions 61*a*, 61*b* are located outside opposite ends of a corresponding one of the three arrays of second adhering portions 62*a*, 62*b*, respectively. That is, the length La of each array of first adhering portions 61*a*, 61*b* in the direction parallel to the arrays P of nozzles 54 is greater than the length Lb of each array of second adhering portions 62*a*, 62*b*, so that the each array of first adhering portions 61*a*, 61*b* extends over the opposite ends of the corresponding array of second adhering portions 62*a*, 62*b*. Thus, the first adhering portions 61 are widely distributed in the three arrays parallel to the arrays P of nozzles 54, and accordingly the two ejector units 6 can be strongly fixed to the cover plate 44.

Next, there will be described a construction of each ejector unit 6 by reference to FIGS. 9 through 14. As described above, each ejector unit 6 includes the cavity plate 10, the nozzle sheet 43, the piezoelectric actuator 20, and the flexible flat cable 40. The cavity plate 10 is provided by a plurality of metallic sheets that are stacked on each other. The nozzle sheet 43 is fixed, by adhesion, to a lower surface of the cavity plate 10. The piezoelectric actuator 20 is a sheet-stacked-type one that is provided by a plurality of piezoelectric sheets that are stacked on each other, and is stacked on, and fixed with adhesive or an adhesive sheet to, an upper surface of the cavity plate 10. The flexible flat cable 40 is provided on an upper surface of the piezoelectric actuator 20.

Figure 9:
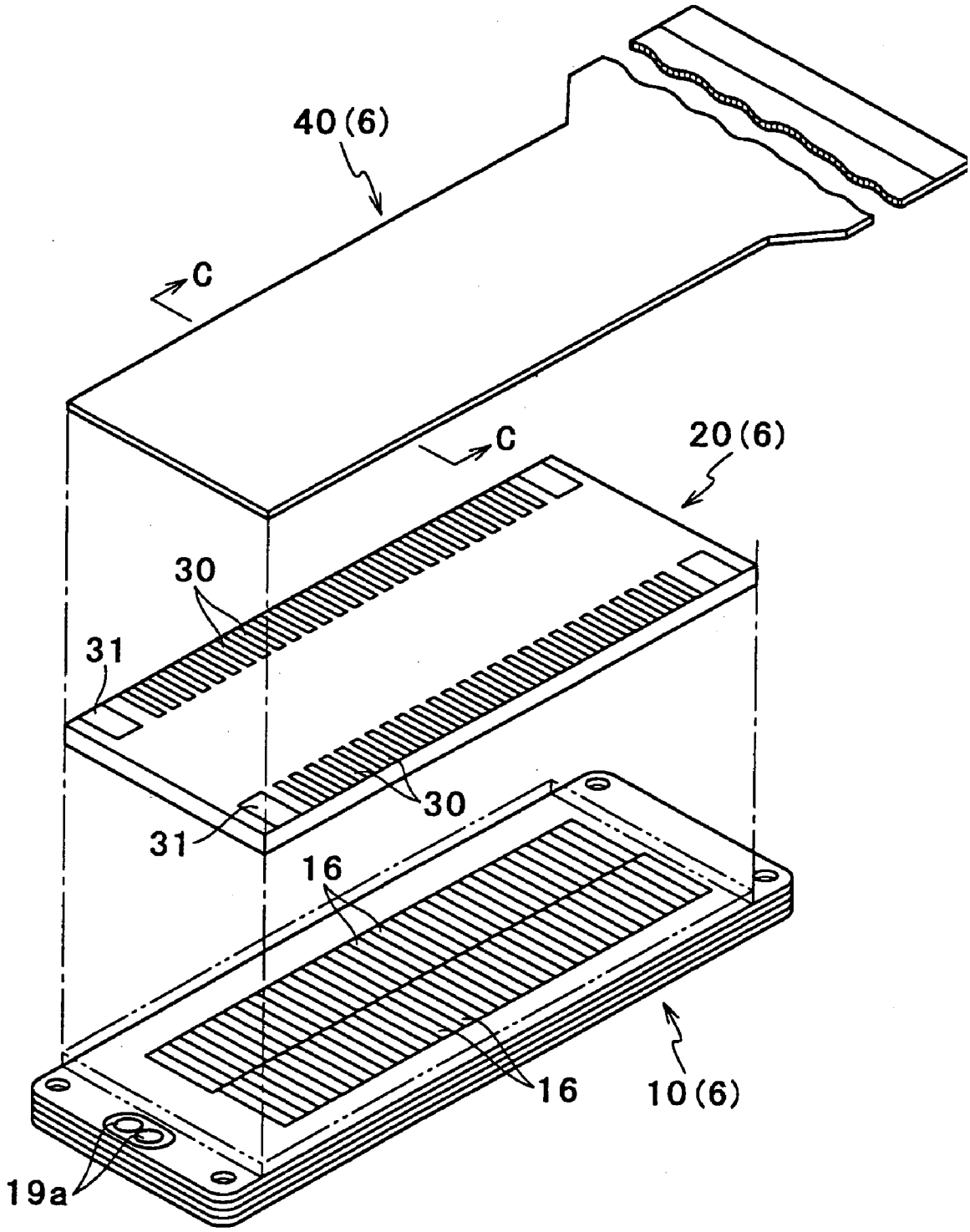
FIG. 9 is a perspective view of each ejector unit of the printer head of FIG. 1.

The flexible flat cable 40 has various wiring patterns that are electrically connected to first and second surface electrodes 30, 31 of the piezoelectric actuator 20, as shown in FIG. 9, and is electrically connected to an external device, not shown. The first and second surface electrodes 30, 31 of the piezoelectric actuator 20 will be described later.

Figure 10:
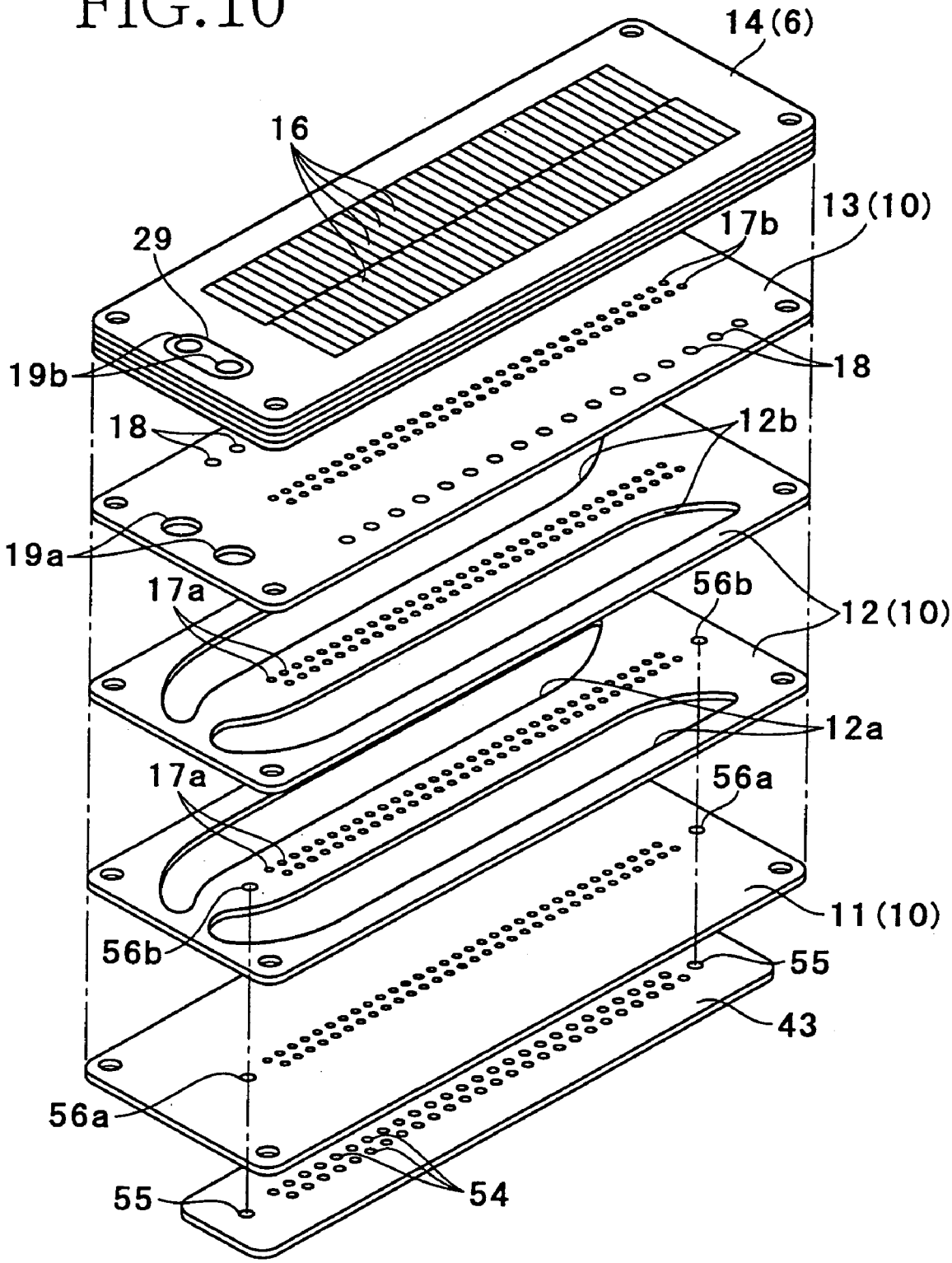
FIG. 10 is a perspective view of a cavity plate and a nozzle sheet of each ejector unit of the printer head of FIG. 1.
Figure 11:
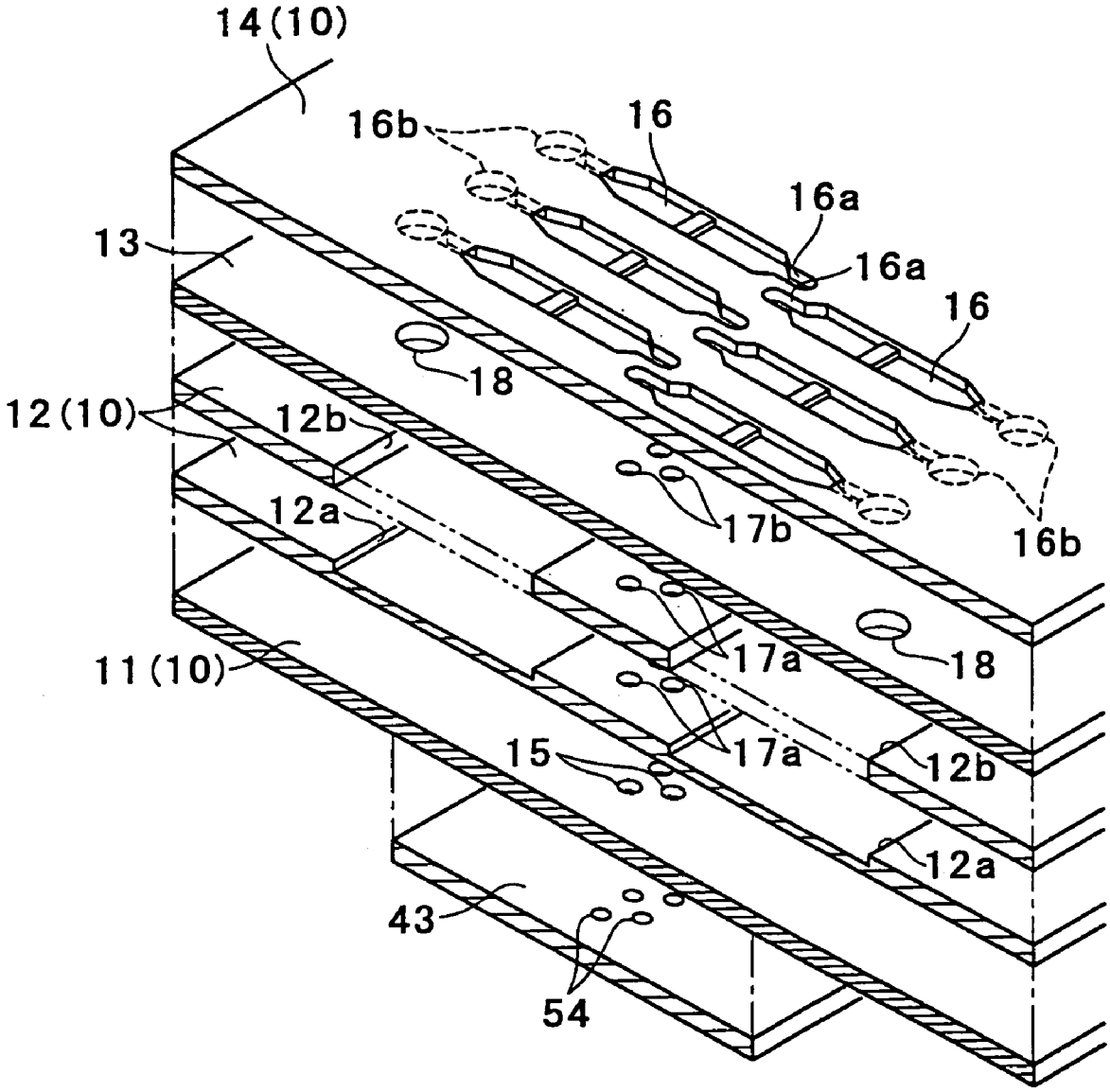
FIG. 11 is an enlarged, perspective view of the cavity plate of FIG. 10, showing a transverse cross section of the cavity plate.
Figure 12:
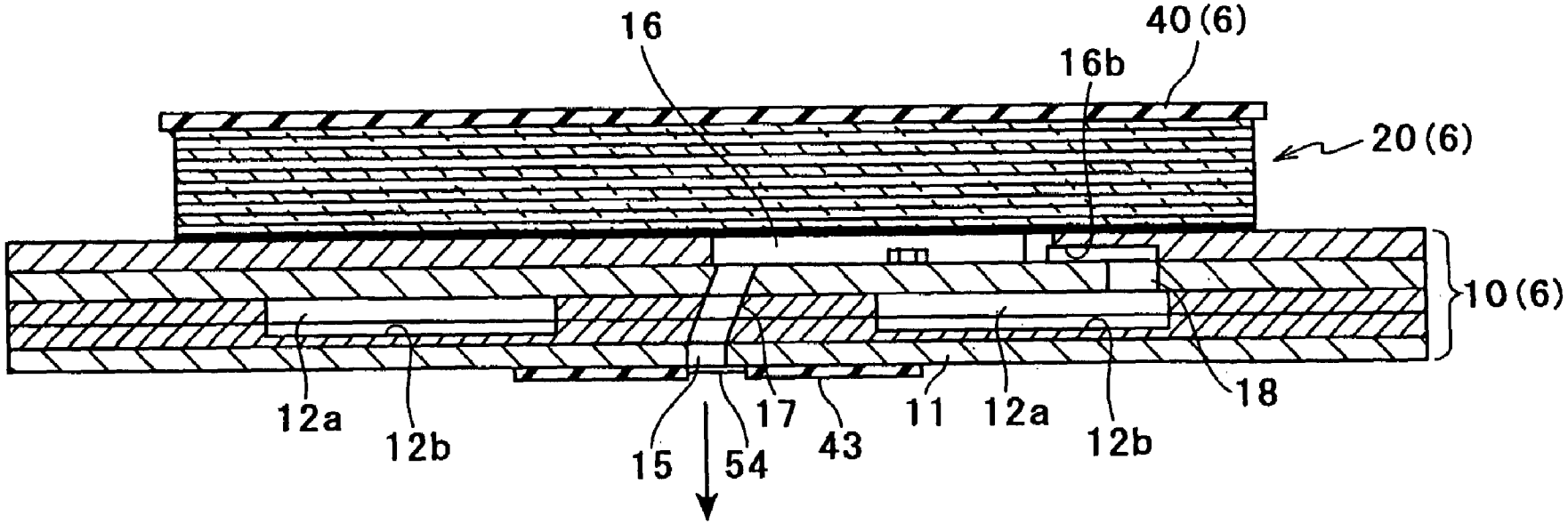
FIG. 12 is a transverse cross section view of the ejector unit of FIG. 9.

In FIG. 10, the nozzle sheet 43 is provided by a thin sheet formed of a synthetic resin, and is adhered to a central portion of the lower surface of the cavity plate 10. The nozzle sheet 43 has the plurality of nozzles 54 that are arranged in two arrays in a staggered or zigzag fashion in a lengthwise direction of the sheet 43. The ejector unit 6 ejects a droplet of ink in a downward direction from each of the nozzles 54. The nozzle sheet 43 has two positioning holes 55 that are formed through the thickness of two opposite end portions thereof, respectively. The manner in which the positioning holes 55 are used will be described later.

As shown in FIG. 10, the cavity plate 10 includes a bottom sheet 11, two manifold sheets 12, a spacer sheet 13, and a base sheet 14. Those sheets are provided by, e.g., thin metallic sheets and are stacked on, and adhered by adhesion to, each other.

The bottom sheet 11 has a lower surface to which the nozzle sheet 43 is adhered, and an upper surface to which the lower one of the two manifold sheets 12 is adhered. The lower manifold sheet 12 has two first ink passages 12*a* that are formed in an upper surface thereof and open in the upper surface only and respectively extend on opposite sides of two arrays of through-holes 17 thereof that are opposite to each other in a widthwise direction thereof. The upper manifold sheet 12 has two second ink passages 12*b* that are formed through the thickness thereof and respectively extend on opposite sides of two arrays of through-holes 17 thereof that are opposite to each other in a widthwise direction thereof. The two first ink passages 12*a* and the two second ink passages 12*b* cooperate with each other to provide two common ink manifolds 12*a*, 12*b*; 12*a*, 12*b*, respectively. Respective upper openings of the two common ink manifolds 12*a*, 12*b*; 12*a*, 12*b* are closed by the spacer sheet 13. The bottom sheet 11 has two positioning holes 56*a* that are formed through the thickness of two lengthwise opposite end portions thereof, respectively, and are aligned with the two positioning holes 55 of the nozzle sheet 43, respectively; and the lower manifold sheet 12 has two positioning holes 56*b* that are formed through the thickness of two lengthwise opposite end portions thereof, respectively, and are aligned with the two positioning holes 55 of the nozzle sheet 43, respectively, and the two positioning holes 56*a* of the bottom sheet 11, respectively.

The spacer sheet 13 has two ink-supply holes 19*a* that are formed through the thickness of one of lengthwise opposite end portions thereof and communicate with respective one end portions of the two common ink manifolds 12*a*, 12*b*; 12*a*, 12*b*; and the base sheet 14 has two ink-supply holes 19*b* that are formed through the thickness of one of lengthwise opposite end portions thereof and communicate with the respective one end portions of the two common ink manifolds 12*a*, 12*b*; 12*a*, 12*b* via the two ink supply holes 19*a* of the spacer sheet 13. In a state in which the two ejector units 6 are assembled with the frame member 2, the four ink supply holes 19*b*, in total, of the two ejector units 6 are held in contact with the four packing members 47, respectively, and communicate with the four ink supply passages 4*a*–4*d* of the frame member 2, respectively. The ink supply holes 19*b* of the base sheet 14 are equipped with a filter member 29 that removes dust from the inks supplied from the ink tanks, not shown. The filter member 29 is adhered with adhesive to the upper surface of the base sheet 14.

The base sheet 14 has a plurality of elongate pressure chambers 16 that are arranged in two arrays in a zigzag manner in a lengthwise direction of the sheet 14. Each of the pressure chambers 16 extends from a widthwise middle portion of the base sheet 14 toward a widthwise end portion of the same 14.

An inner end portion 16*a* of each of the pressure chambers 16 communicates with a corresponding one of the nozzles 54 via a corresponding one of through-holes 17*b* formed through the thickness of the spacer sheet 13, a corresponding one of the through-holes 17*a* formed through the thickness of the upper manifold sheet 12, a corresponding one of the through-holes 17*a* formed through the thickness of the lower manifold sheet 12, and a corresponding one of through-holes 15 formed through the thickness of the bottom sheet 11. An outer end portion 16*b* of each pressure chamber 16 communicates with a corresponding one of the two common ink manifolds 12*a*, 12*b*; 12*a*, 12*b* via a corresponding one of communication holes 18 formed through the thickness of the spacer sheet 13.

In the ink jet printer head 1 constructed as described above, the four inks supplied through the four ink supply passages 4*a*–4*d* flow to the four common ink manifolds 12*a*, 12*b* of the two ejector units 6 via the four ink supply holes 19*b* of the two base sheets 14 and the four ink supply holes 19*a* of the two spacer sheets 13, respectively, and then flow from the four ink manifolds 12*a*, 12*b* to the respective outer end portions 16 of the four arrays of pressure chambers 16 of the two base sheets 14 via the four arrays of communication holes 18 of the two spacer sheets 12. The ink flowing from the inner end portion 16*a* of each pressure chamber 16 reaches a corresponding one of the four arrays of nozzles 54 of the two nozzle sheets 43 via a corresponding one of the four arrays of through-holes 17*b* of the two spacer sheets 13, a corresponding one of the four arrays of through-holes 17*a* of the two upper manifold sheets 12, a corresponding one of the four arrays of through-holes 17*a* of the two lower manifold sheets 12, and a corresponding one of the four arrays of through-holes 15 of the two bottom sheets 11.

Figure 13:
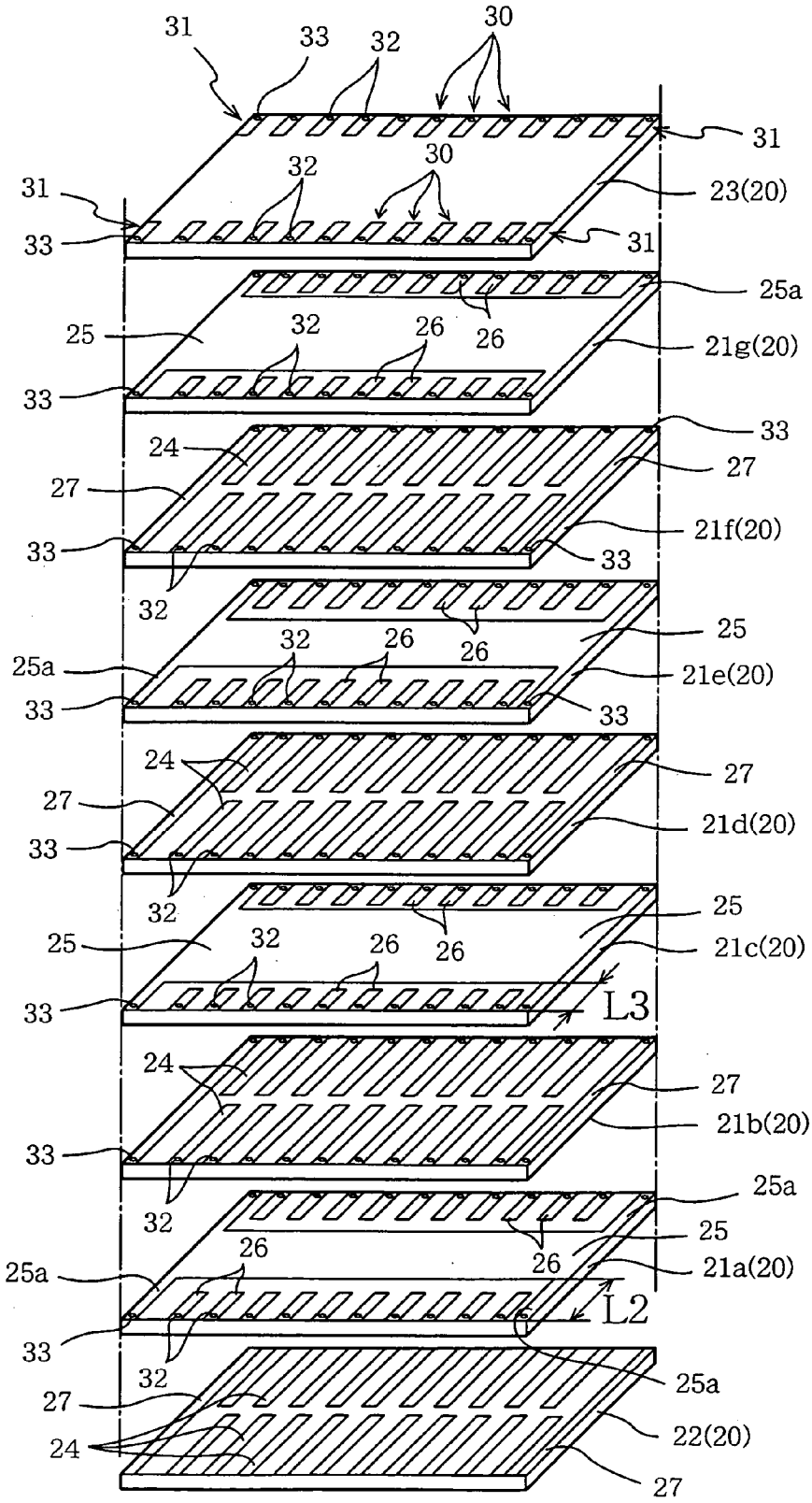
FIG. 13 is an exploded, perspective view of a piezoelectric actuator of FIG. 12.
Figure 14:
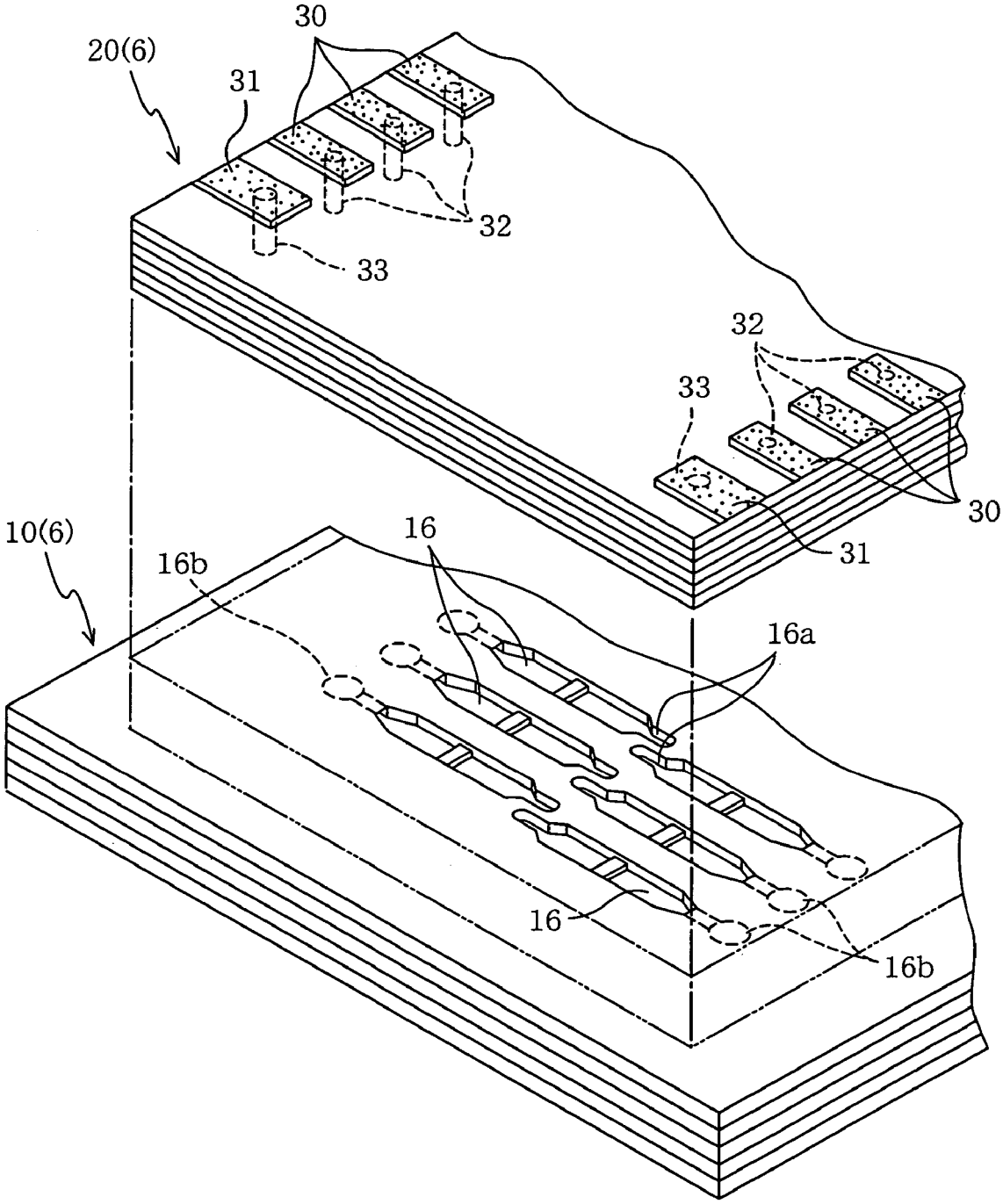
FIG. 14 is an exploded, perspective view of respective portions of the cavity plate and the piezoelectric actuator shown in FIG. 12.

As shown in FIG. 13, the piezoelectric actuator 20 has a structure in which a plurality of (e.g., nine) piezoelectric sheets 21*a*, 21*b*, 21*c*, 21*d*, 21*e*, 21*f*, 21*g*, 22, 23 are stacked on each other. On an upper surface of each of the lowermost piezoelectric sheet 22 and the third, fifth, and seventh piezoelectric sheets 21*b*, 21*d*, 21*f* as counted in an upward direction from the lowermost sheet 22, there are provided a plurality of elongate proper individual electrodes 24 which are aligned with the pressure chambers 16 of the cavity plate 10, respectively, and are arranged in two arrays in a zigzag fashion in a lengthwise direction of the each piezoelectric sheet 22, 21*b*, 21*d*, 21*f*.

In addition, on an upper surface of each of the second, fourth, sixth, and eighth piezoelectric sheets 21*a*, 21*c*, 21*e*, 21*g* as counted in the upward direction from the lowermost sheet 22, there is provided a proper common electrode 25 which is aligned commonly to all the pressure chambers 16.

Moreover, on an upper surface of the uppermost piezoelectric sheet 23, there are provided a plurality of first surface electrodes 30 which are arranged in two arrays in widthwise opposite edge portions of the sheet 23 along two long sides thereof, and are aligned, in their plan view, with the proper individual electrodes 24, respectively, provided on each of the four sheets 22, 21*b*, 21*d*, 21*f*, and four second surface electrodes 31 which are aligned with two lead portions 25*a* of each of the four common electrodes 25. The first surface electrodes 30 and the proper individual electrodes 24 are electrically connected to each other via an electrically conductive material provided in through-holes 32 that are formed through the thickness of each of the sheets 21*a*–21*g* and 23 and a plurality of dummy individual electrodes 26 provided on each of the second, fourth, and sixth sheets 21*a*, 21*c*, 21*e*, 21*g*; and, likewise, the second surface electrodes 31 and the proper common electrodes 25 (or the lead portions 25*a* thereof) are electrically connected to each other via an electrically conductive material provided in through-holes 33 that are formed through the thickness of each of the sheets 21*a*–21*g* and 23 and a plurality of dummy common electrodes 27 provided on each of the lowermost sheet 22 and the third, fifth, and seventh sheets 21*b*, 21*d*, 21*f*. As described previously, the wiring patterns of the flexible flat cable 40 (FIG. 1) are electrically connected to the surface electrodes 30, 31 provided on the upper surface of the piezoelectric actuator 20.

Since each ejector unit 6 has the above-described construction, when an electric voltage is applied to the common electrodes 25 and the respective individual electrodes 24 on the piezoelectric sheets 22, 21*b*, 21*d*, 21*f* that are aligned with an arbitrary one of the pressure chambers 16, respective portions of the piezoelectric sheets 21*a*–21*g* that are aligned with the arbitrary pressure chamber 16 are deformed, by piezoelectric effect, in a direction of stacking of the sheets 21*a*–21*g*, 22, 23. This deformation decreases a volume of the arbitrary pressure chamber 16, so that a droplet of ink accommodated in the chamber 16 is ejected from the nozzle 54 communicating with the same 16, toward the recording sheet so as to record an image.

Next, there will be described a method of producing an ink jet printer head 1 by adhering a plurality of (e.g., two) ejector units 6, a cover plate 44, and a frame member 2 to each other.

Figure 15:
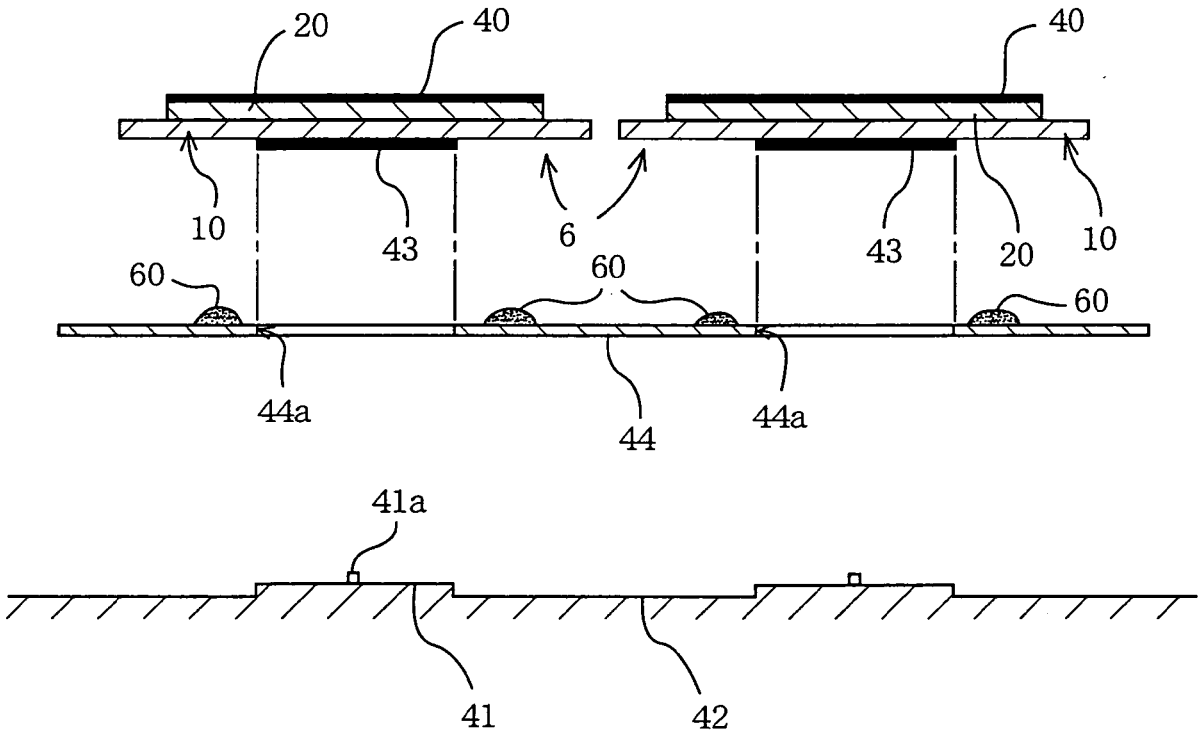
FIG. 15 is a view for explaining a state in which the two ejector units and the cover plate are positioned relative to each other in a method of producing the ink jet printer head of FIG. 1, to which the present invention is also applied.
Figure 16C:
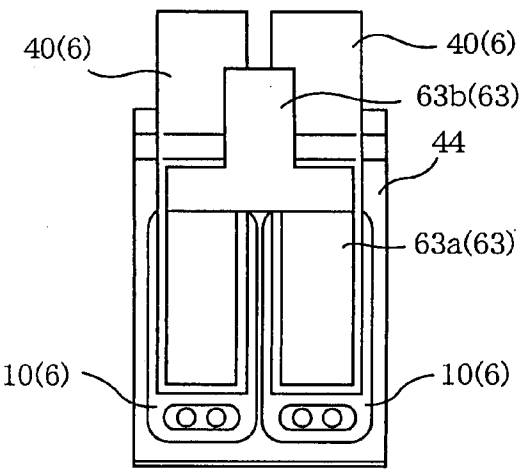
FIGS. 16A, 16B, and 16C are views for explaining a sealing step of the method of producing the ink jet printer head of FIG. 1.

In FIG. 15, first, the cover plate 44 is placed on a jig plate 42 as a support member, while the cover plate 44 is taking a posture in which the bent portions 44*b*, 44*c* thereof project upward. More specifically described, the jig plate 42 has two flat lands 41 each of which is somewhat smaller than each of the two first openings 44*a* of the cover plate 44, and the cover plate 44 is positioned relative to the jig plate 42 such that the two lands 41 are received in the two first openings 44*a*, respectively. In this state, the sealing agent 60 is applied to a periphery of each first opening 44*a* of the cover plate 44, as indicated at hatching in FIG. 16A.

Figure 16B:
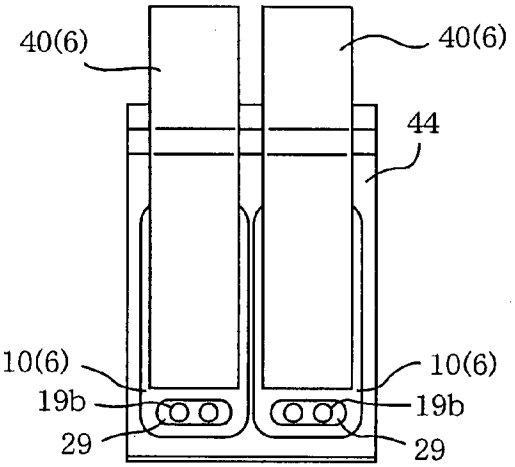
Figure 16A:
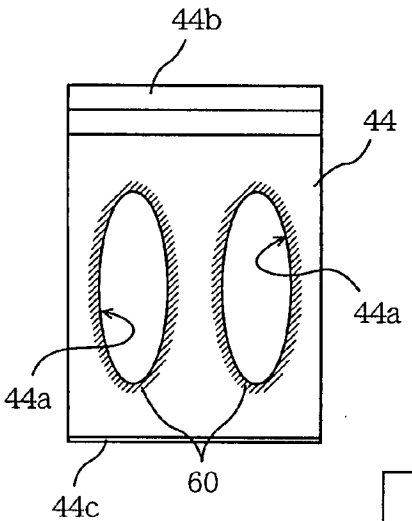

Subsequently, as shown in FIG. 16B, the two ejector units 6, each of which includes the nozzle sheet 43, the cavity plate 10, the piezoelectric actuator 20, and the flexible flat cable 40 that are assembled with each other, are placed on the cover plate 44. Each of the two lands 41, respectively exposed through the two first openings 44*a*, has two positioning pins 41*a*, and each of the two ejector units 6 is placed on the cover plate 44, such that the two positioning pins 41*a* are inserted in the positioning holes 55, 56*a*, 56*b* of the each ejector unit 6. Thus, the two ejector units 6 are positioned relative to the cover plate 44, such that the nozzles 54 of one of the two ejector units 6 are accurately positioned relative to the nozzles 54 of the other ejector unit 6. In this state, the sealing agent 60 is provided, between the upper surface of the cover plate 44 and the respective lower surfaces of the two ejector units 6, around the two first openings 44*a*, such that the nozzles 54 of the two ejector units 6 are exposed downward through the two first openings 44*a*, respectively.

Next, as shown in FIG. 16C, in a state in which the sealing agent 60 has not been hardened yet, a pressing member 63 is operated by an operator to press, in a downward direction, the two ejector units 6 against the cover plate 44, so that the ejector units 6 and the cover plate 44 cannot be moved relative to each other. In this state, a first adhering step is carried out in which the two ejector units 6 and the cover plate 44 are adhered and fixed to each other using the first adhesive. The pressing member 63 includes two pressing portions 63*a* that act on the two ejector units 6, respectively, and a handle portion 63*b* that is grasped by the operator.

Figure 16E:
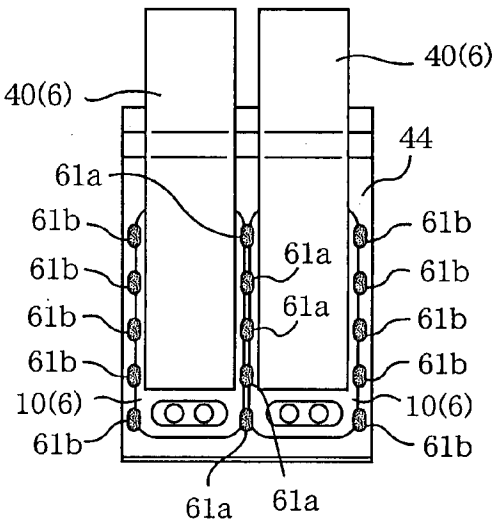
FIGS. 16D and 16E are views for explaining a first adhering step of the method of producing the ink jet printer head of FIG. 1.
Figure 16D:
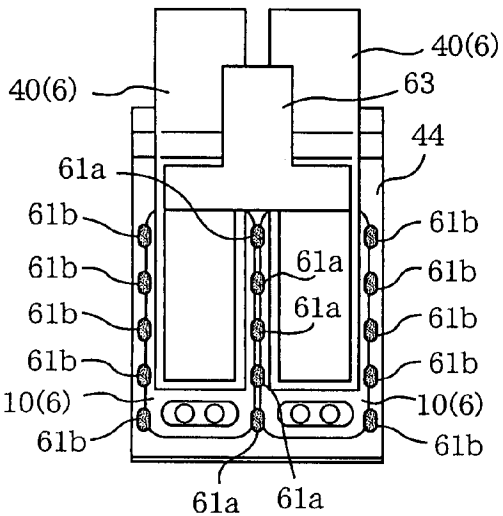

As shown in FIG. 16D, in the first adhering step, a dispenser in the form of a hollow needle, not shown, (this dispenser is identical with a dispenser used to apply the second adhesive, described later) is used to apply the first adhesive (i.e., an UV-light sensitive adhesive) in the form of spots arranged at a substantially regular interval of distance along widthwise opposite edge portions of the respective cavity plates 10 that constitute respective exposed portions of the two ejector units 6, i.e., in the lengthwise direction of the cavity plates 10. When the first adhesive is hardened upon exposure to UV light, the first adhesive portions 61*a*, 61*b*, described above in connection with the construction of the ink jet printer head 1, are formed. After the first adhesive portions 61*a*, 61*b* are formed by hardening the first adhesive, the pressing member 63 is released from the two ejector units 6. Thus, as shown in FIG. 16E, a subassembly including the two ejector units 6 and the cover plate 44 that are adhered and fixed to each other with the first adhesive portions 61*a*, 61*b* is obtained.

In the above-described first adhering step, the first adhesive portions 61 are formed in the state in which the two ejector units 6 are pressed against the cover plate 44 by the pressing member 63, even though the sealing agent 60 provided between the ejector units 6 and the cover plate 44 may not have been hardened yet. Therefore, the ejector units 6 and the cover plate 44 can be fixed in position relative to each other. Thus, the present step is free of the problems that the ejector units 6 and the cover plate 44 may be moved relative to each other and the sealing agent 60 flows or moves and that sealing defects such as bubbles or uneven sealing may occur to the sealing portions provided by the sealing agent 60.

On the other hand, if the pressing member 63 is used to press the two ejector units 6 to the cover plate 44 via the sealing agent 60, so that the ejector units 6 and the cover plate 44 are once held in close contact with each other, but thereafter the pressing member 63 is released from the ejector units 6, without carrying out the above-described first adhering step, the ejector units 6 and the cover plate 44 can easily be moved relative to each other, and accordingly gaps may easily be produced, because the sealing agent 60 has not been hardened yet. In addition, the sealing agent 60 can easily be flowed or moved and accordingly can easily be distributed unevenly like waves. Therefore, the above-explained defects can easily occur. It is possible to continue pressing, with the pressing member 63, the ejector units 6 against the cover plate 44, till the sealing agent 60 is completely hardened. However, generally, the speed of hardening of the sealing agent 60 is considerably low, and accordingly the efficiency of production of the ink jet printer head 1 is lowered. In contrast, in the present producing method, the first adhering step is carried out, and accordingly the ejector units 6 and the cover plate 44 can be surely adhered and fixed to each other, irrespective of the degree of hardening of the sealing agent 60. Thus, the defects of the sealing agent 60 can be surely prevented without lowering the efficiency of production of the ink jet printer head 1.

Figure 17A:
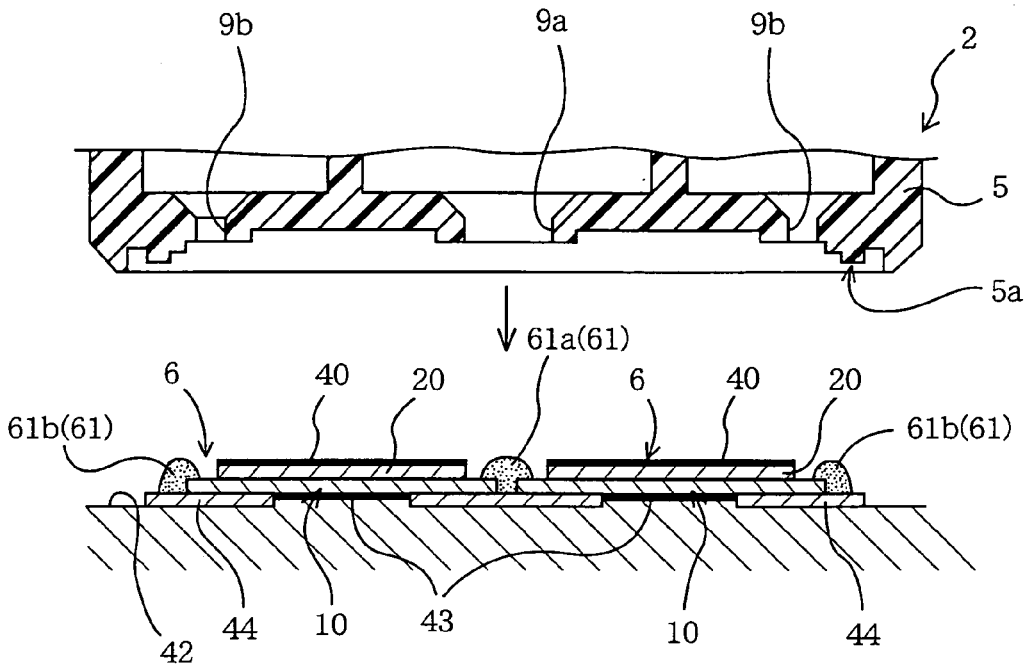
FIGS. 17A and 17B are cross-section views, taken along 17A—17A and 17B—17B in FIG. 4, respectively, for explaining a second adhering step of the method of producing the ink jet printer head of FIG. 1.

As shown in FIG. 17A, after the first adhering step is finished, the frame member 2 is placed on the subassembly including the two head units 6 and the cover plate 44, such that the two ejector units 6 are accommodated in a recess 5*a* formed in the bottom wall 5 of the frame member 2.

Figure 17B:
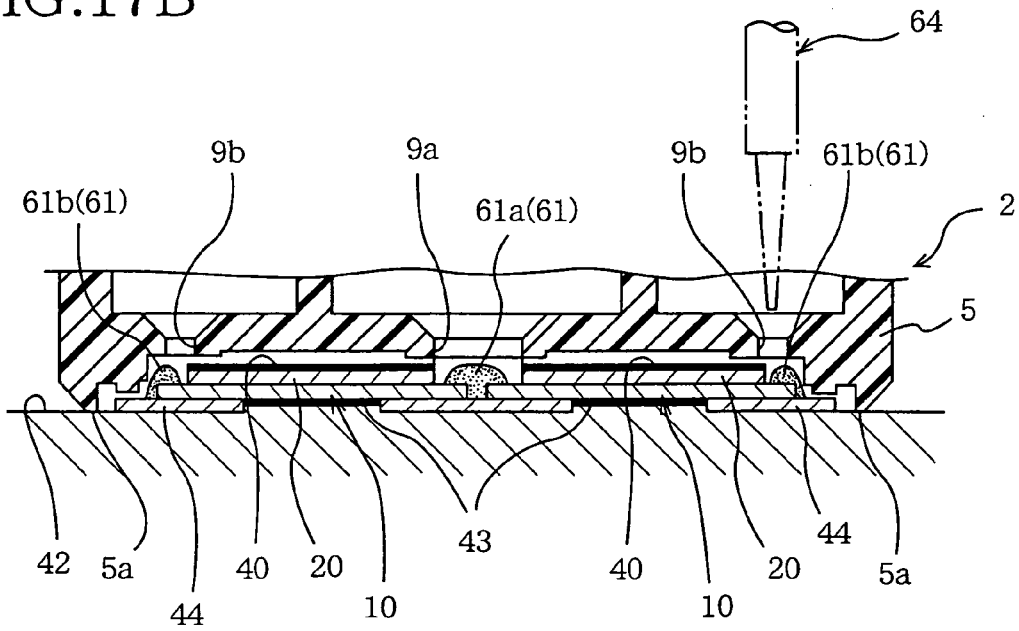

As shown in FIG. 17B, after the frame member 2 is placed on the subassembly 6, 44, a dispenser 64 in the form of a hollow needle is used to inject the second adhesive (i.e., a UV-light sensitive adhesive) into the second openings 9*a*, 9*b* of the frame member 2. After an appropriate amount of the second adhesive is charged into each of the second openings 9*a*, 9*b*, the second adhesive is hardened upon exposure to an UV light and thus the second adhesive portions 62, shown in FIG. 6, are formed. In this way, the subassembly including the two ejector units 6 and the cover plate 44 is adhered and fixed to the bottom wall 5 of the frame member 2, and thereafter the ink jet printer head 1 is removed off the jig plate 41. Then, the sealing agent 45 is charged into clearances left between an outer periphery of the cover plate 44 and the frame member 2.

As is apparent from the foregoing description, the ink jet printer head 1 and the method of producing the same 1 can improve the adhesive strength of the ejector units 6 and can effectively prevent the defects of the sealing portions provided by the sealing agent 60 interposed between the ejector units 6 and the cover plate 44.

While the present invention has been described in its preferred embodiment, it is to be understood that the present invention may otherwise be embodied.

For example, the bottom wall 5 of the frame member 2 may not have any second openings 9. In this case, the frame member 2 is placed over the subassembly including the ejector units 6 and the cover plate 44, such that the second adhesive is interposed between the subassembly 6, 44 and the frame member 2 so as to adhere the two elements to each other. Thus, the second adhesive portions 62 are formed of the second adhesive.

In addition, the first adhesive portions 61 may not include any portions that are not aligned, in their plan view, with the second openings 9. Moreover, the first and second adhesive portions 61, 62 may not be formed as described previously, i.e., such that they are arranged at the respective substantially regular intervals of distance, in the mixed arrays substantially parallel to the arrays of nozzles 54. Furthermore, the opposite end portions of the arrays of first adhesive portions 61 may not be located outside the opposite ends of the corresponding arrays of second adhesive portions 62.

The ink jet printer head 1 may be modified not to include the two ejector units 6, i.e., may be modified to include a single ejector 6 or three or more ejector units 6. In addition, the respective total numbers of the second openings 9, the first adhesive portions 61, and the second adhesive portions 62 may be arbitrarily selected.

Figure 18A:
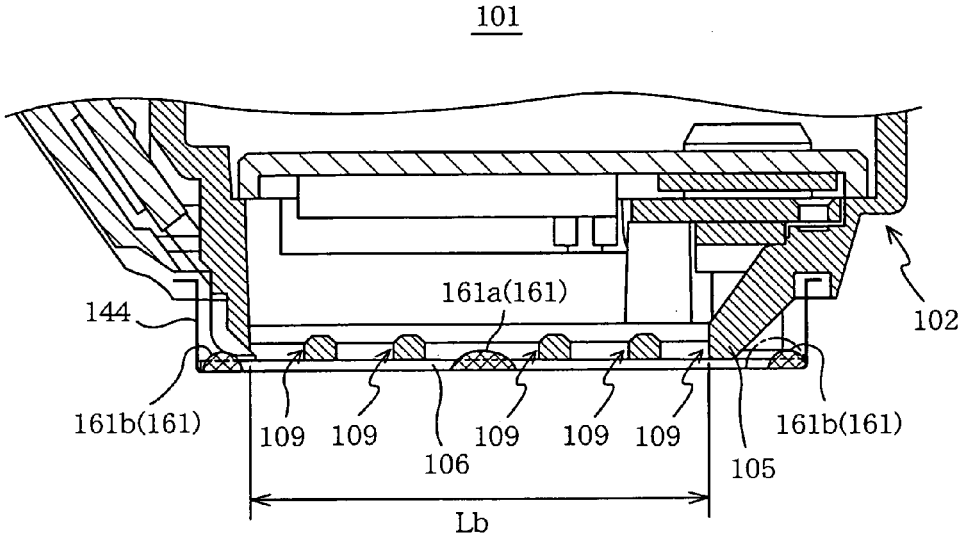
FIG. 18A is a cross-section view of another ink jet printer head as a second embodiment of the present invention.
Figure 18B:
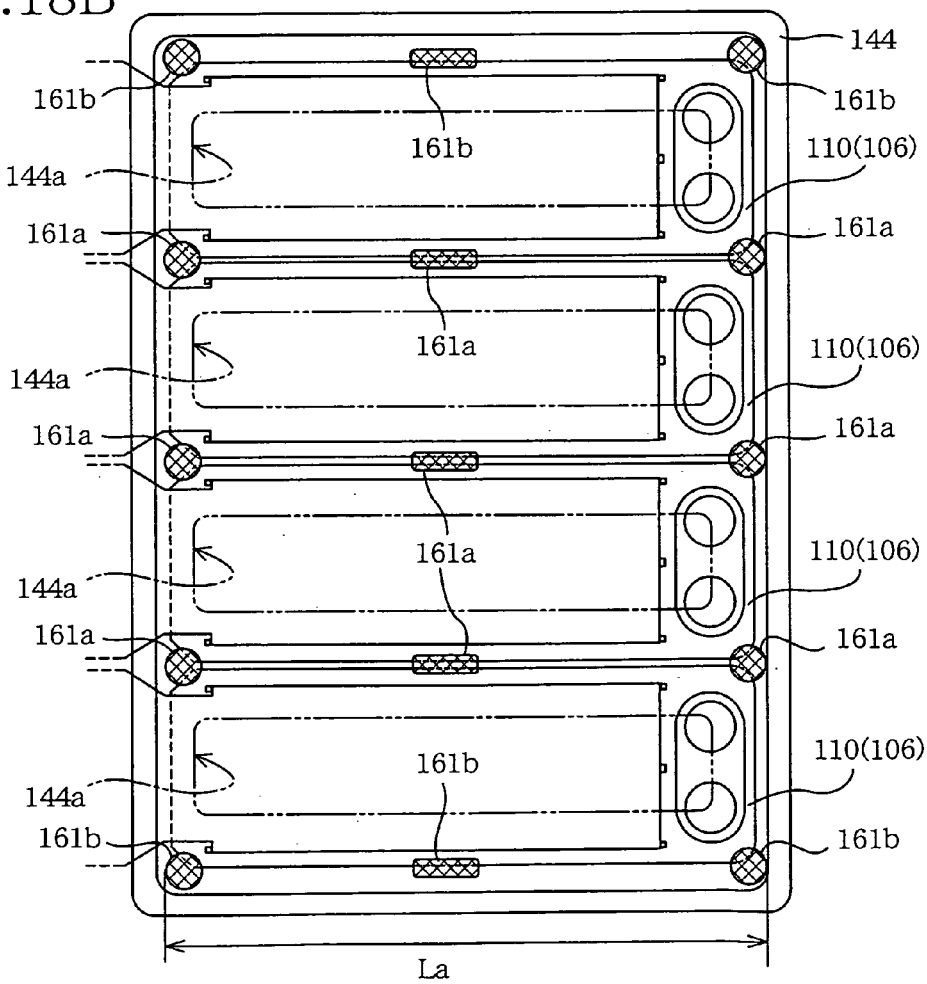
FIG. 18B is a plan view of four ejector units and a cover plate of the ink jet printer head of FIG. 18A.

For example, FIGS. 18A and 18B show another ink jet printer head 101 as another embodiment of the present invention. The present ink jet printer head 101 includes a frame member 102 including a bottom wall 105; four ejector units 106 including respective cavity plates 110; and five arrays of second openings 109 each array of which includes five second openings 109. FIG. 18A shows one array of second openings 109 in which a second adhesive has not been injected yet; and FIG. 18B shows a subassembly including the four ejector units 106 and a cover plate 144 having four first openings 144*a*. The five arrays of second openings 109 are formed in the bottom wall 105 of the frame member 102, such that the five arrays of second openings 109 are arranged along respective edge lines of the four ejector units 106 that are parallel to respective arrays of nozzles, not shown, of the same 106. Therefore, the central, three arrays of second openings 109 are each aligned with respective edge lines of two ejector units 106 that are adjacent each other. The four ejector units 106 and the cover plate 144 are adhered to each other by five arrays of first adhesive portions 161 (161*a*, 161*b*) each array of which includes a plurality of separate first adhesive portions 161. However, each array of first adhesive portions 161 may be replaced with a single continuous first adhesive portion. A total length La of each array of first adhesive portions 161 is longer than a total length Lb of each array of second openings 109, and accordingly respective opposite end portions of each array of first adhesive portions 161 are not aligned, in their plan view, with the corresponding array of second openings 109. Five arrays of second adhesive portions, not shown, are formed by hardening of the second adhesive injected in the second openings 109.

Each of the first and second adhesives may be different from the UV-light sensitive adhesive. In this case, too, it is preferred that the first adhesive be hardened more quickly than the sealing agent.

Each ejector unit 6, 106 may be replaced with any sort of ejector unit that has, in an outer surface thereof that opposes a recording medium, a plurality of nozzles each of which ejects a droplet of ink toward the recording medium. That is, the cavity plate 10, 110, the piezoelectric actuator 20, the nozzle sheet 43, and the flexible flat cable 40 of each ejector unit 6, 106 may be modified in various manners.

In each of the illustrated embodiments, the frame member 2, 102 has at least one second opening 9, 109 which is formed through the thickness of the bottom wall 5, 105 thereof and is opposed to at least one portion of the subassembly 6, 44; 106, 144 in a reference direction perpendicular to the bottom wall 5, 105, and at least one second adhering portion 62 is aligned with at least one second opening 9, 109 in the reference direction. According to this feature, the second adhering portion 62 can be formed by just pouring the second adhesive into the second opening 9, 109, in the state in which the subassembly including the ejector unit 6, 106 and the cover member 44, 144, and the frame member 2, 102 are positioned relative to each other. Thus, the subassembly including the ejector unit 6, 106 and the cover member 44, 144 can be easily adhered and fixed to the bottom wall 5, 105 of the frame member 2, 102.

In each of the illustrated embodiments, at least one first adhering portion 61, 161 comprises at least one non-alignment first adhering portion which is not aligned with at least one second opening 9, 109 of the bottom wall 5, 105 of the frame member 2, 102 in the reference direction. According to this feature, the ejector unit 6, 106 and the cover plate 44, 144 can be adhered and fixed to each other by the non-alignment first adhering portion 61, 161, i.e., at the position where no second adhering portion 62 can be formed by pouring the second adhesive into the second opening 9, 109 of the frame member 2, 102. Therefore, the adhesive strength of the ink jet printer head 1, 101 can be further improved.

In each of the illustrated embodiments, the nozzles 54 of at least one ejector unit 6, 106 are provided in at least one array P, and the ink jet printer head 1, 101 comprises a plurality of first adhering portions 61, 161 which are provided in at least one array along at least one reference line substantially parallel to at least one array of nozzles 54, such that the first adhering portions 61, 161 are arranged at a first, substantially regular interval of distance, and a plurality of second adhering portions 62 which are provided in at least one array along the reference line, such that the second adhering portions 62 are arranged at a second, substantially regular interval of distance and are mixed with the first adhering portions 61, 161 within a predetermined range along the reference line.

In each of the illustrated embodiments, the first and second adhering portions 61, 161, 62 are arranged in the respective arrays, at the respective substantially regular intervals of distance, along the reference line substantially parallel to the array P of nozzles 54, and are mixed with each other within the predetermined range along the reference line. Therefore, the components of the ink jet printer head 1, 101 are adhered and fixed to each other at the respective positions which are substantially uniformly distributed along the array of nozzles 54. Thus, the adhesive strength of the ink jet printer head 1, 101 as a whole can be well balanced and still improved.

In each of the illustrated embodiments, the nozzles 54 of at least one ejector unit 6, 106 are provided in at least one array, and at least one first adhering portion 61, 161 is provided along at least one reference line substantially parallel to at least one array P of nozzles 54, such that lengthwise opposite ends of at least one first adhering portion 61, 161 are located outside lengthwise opposite ends of at least one second adhering portion 62, respectively. According to this feature, the first adhering portion 61, 161 that is provided along the reference line substantially parallel to the array P of nozzles 54, has the feature that the lengthwise opposite ends thereof are located outside the lengthwise opposite ends of the second adhering portion 62, respectively. Therefore, the ejector unit 6, 106 and the cover member 44, 144 can be more strongly fixed to each other by the first adhering portion 61, 161 that is widely provided along the reference line.

In each of the illustrated embodiments, at least one sealing portion 60 is formed of the sealing agent, and at least one first adhering portion 61, 161 is formed of the first adhesive which hardens more quickly than the sealing agent. According to this feature, before the sealing agent 60 provided between the ejector unit 6, 106 and the cover member 44, 144 hardens, the first adhesive constituting the first adhering portion 61, 161 hardens, so that the ejector unit 6, 106 and the cover member 44, 144 are fixed in position relative to each other. Therefore, the ink jet printer head 1, 101 is surely freed of the problem that the ejector unit 6, 106 and the cover member 44, 144 may be displaced relative to each other and the sealing portion 60 may suffer the sealing defects.

In each of the illustrated embodiments, the ink jet printer head 1, 101 comprises the plurality of ejector units 6, 106, the cover member 44, 144 has the plurality of first openings 44*a*, 144*a* corresponding to the ejector units 6, 106, respectively, and at least one adhering portion 61, 161 adheres, and thereby fixes, the ejector units 6, 106 and the cover member 44, 144 to each other, such that the nozzles 54 of each one of the ejector units 6, 106 are positioned relative to the nozzles 54 of the other ejector unit or units 6, 106. According to this feature, the ejector units 6, 106 are fixed to the cover member 44, 144, such that the nozzles 54 of each one of the ejector units 6, 106 are positioned relative to the nozzles 54 of the other ejector unit or units 6, 16. Therefore, the ejector units 6, 106 can eject respective droplets of ink at respective accurate positions on the recording medium and thereby perform recording with high quality.

In each of the illustrated embodiments, at least one first adhering portion 61, 161 is formed of the ultraviolet-light sensitive adhesive which hardens upon exposure to the ultraviolet light. According to this feature, the first adhering portion 61, 161 is constituted by the ultraviolet-light sensitive adhesive which hardens upon exposure to the ultraviolet light. Therefore, the first adhering portion 61, 161 can be quickly hardened in a very short time. Thus, the ink jet printer head 1, 101 is surely freed of the defects that may be produced between the ejector unit 6, 106 and the cover member 44, 144.

In each of the illustrated embodiments, at least one second adhering portion 62 is formed of the ultraviolet-light sensitive adhesive which hardens upon exposure to the ultraviolet light. According to this feature, the second adhering portion is constituted by the ultraviolet-light sensitive adhesive which hardens upon exposure to the ultraviolet light. Therefore, the second adhering portion 62 can be quickly hardened in a very short time.

In each of the illustrated embodiments, the sealing portion 60 is formed of the sealing agent, and the sealing agent comprises the silicone adhesive. According to this feature, the sealing portion 60 is constituted by the silicone adhesive. Therefore, the ejector unit 6, 106 and the cover member 44, 144 are not only fluid-tightly sealed to each other but also adhered to each other. Thus, the sealing portion 60 can be easily provided in the form of a layer between the ejector unit 6, 106 and the cover member 44, 144.

In each of the illustrated embodiments, the ink jet printer head producing method comprises the step of preparing the frame member 2, 102 having at least one second opening 9, 109 which is formed through the thickness of the bottom wall 5, 105 thereof, and the step of adhering with the second adhesive comprises applying, through the second opening 9, 109 of the frame member 2, 102, the second adhesive to at least one portion of the subassembly 6, 44; 106, 144. According to this feature, the subassembly including the ejector unit 6, 106 and the cover member 44, 144, and the frame member 2, 102 can be adhered and fixed to each other, by just pouring the second adhesive into the second opening 9, 109, in the state in which the subassembly 6, 44; 106, 144 and the frame member 2, 102 are positioned relative to each other. Thus, the subassembly including the ejector unit 6, 106 and the cover member 44, 144 can be easily adhered and fixed to the bottom wall 5, 105 of the frame member 2, 102.

In each of the illustrated embodiments, the step of adhering with the first adhesive comprises adhering, with the first adhesive, at least one ejector unit 6, 106 and the cover member 44, 144 to each other at at least one portion that is not aligned with the second opening 9, 109 of the bottom wall 5, 105 of the frame member 2, 102, in a reference direction perpendicular to the bottom wall 5, 105 of the frame member 2, 102. According to this feature, the ejector unit 6, 106 and the cover plate 44, 144 can be adhered and fixed to each other at the respective non-alignment portions thereof, i.e., at the positions where no second adhering portion 62 can be formed by pouring the second adhesive into the second opening 9, 109 of the frame member 2, 102. Therefore, the adhesive strength of the ink jet printer head 1, 101 can be further improved.

In each of the illustrated embodiments, at least one first adhering portion 61, 161 is continuously formed on respective exposed portions of at least one ejector unit 6, 106 and the cover member 44, 144. According to this feature, an adhesive can be easily applied to the respective exposed portions of the ejector unit 6, 106 and the cover member 44, 144, and can be quickly hardened upon exposure to, e.g., an UV light. In contrast, since the sealing portion or agent 60 is provided between the ejector unit 6, 106 and the cover member 44, 144, the sealing portion or agent 60 is not exposed and accordingly the UV light cannot be used to harden quickly the sealing agent 60.

In each of the illustrated embodiments, the ink jet printer head 1, 101 comprises the plurality of first adhering portions 61, 161 which are formed in two arrays along widthwise opposite edge lines of at least one ejector unit 6, 106, such that each of the first adhering portions 61, 161 is continuously formed on the respective exposed portions of the ejector unit 6, 106 and the cover member 44, 144. According to this feature, the ejector unit 6, 106 is fixed to the cover member 44, 144 with a great adhesive strength.

It is to be understood that the present invention may be embodied with various changes and improvements that may occur to a person skilled in the art, without departing from the spirit and scope of the invention defined in the appended claims.

What is claimed is:

1. An ink jet printer head, comprising:

at least one ejector unit having, in one of opposite surfaces thereof, a plurality of nozzles each of which ejects a droplet of ink toward a recording medium;

a cover member which has at least one first opening and is fixed to said one surface of said at least one ejector unit such that the nozzles of said at least one ejector unit are exposed through said at least one first opening;

a frame member including a bottom wall to which the other surface of said at least one ejector unit is fixed;

at least one sealing portion which seals a first to-be-sealed portion of the one surface of said at least one ejector unit and a second to-be-sealed portion of the cover member to each other continuously along an entire periphery of said at least one first opening of the cover member;

at least one first adhering portion which adhere to a first exposed edge portion of the other surface of said at least one ejector unit, and additionally adheres to a second exposed portion of the cover member that is different from the second to-be-sealed portion thereof and is adjacent to said first exposed edge portion of said at least one ejector unit, so as to fix said at least one ejector unit and the cover member to each other and thereby provide a subassembly including said at least one ejector unit and the cover member; and at least one second adhering portion which adheres, and thereby fixes, the subassembly including said at least one ejector unit and the cover member, to the bottom wall of the frame member, such that the other surface of said at least one ejector unit is fixed to the bottom wall of the frame member.

2. The ink jet printer head according to claim 1, wherein the frame member has at least one second opening which is formed through a thickness of the bottom wall thereof and is opposed to at least one portion of the subassembly in a reference direction perpendicular to the bottom wall, and wherein said at least one second adhering portion is aligned with said at least one second opening in the reference direction.

3. The ink jet printer head according to claim 2, wherein said at least one first adhering portion comprises at least one non-alignment first adhering portion which is not aligned with said at least one second opening of the bottom wall of the frame member in the reference direction.

4. The ink jet printer head according to claim 1, wherein the nozzles of said at least one ejector unit are provided in at least one array, and wherein the ink jet printer head comprises at least three said first adhering portions which are provided in at least one array along at least one reference line substantially parallel to said at least one array of nozzles, such that the at least three first adhering portions are arranged at a substantially regular interval of distance; and a plurality of said second adhering portions which are provided in at least one array along said at least one reference line, such that the second adhering portions are present together with the first adhering portions within a predetermined range along said at least one reference line.

5. The ink jet printer head according to claim 1, wherein the nozzles of said at least one ejector unit are provided in at least one array, and wherein said at least one first adhering portion is provided along at least one reference line substantially parallel to said at least one array of nozzles, such that lengthwise opposite ends of said at least one first adhering portion are located outside lengthwise opposite ends of said at least one second adhering portion, respectively.

6. The ink jet printer head according to claim 1, wherein said at least one sealing portion is formed of a sealing agent, and wherein said at least one first adhering portion is formed of an adhesive which hardens more quickly than the sealing agent.

7. The ink jet printer head according to claim 1, comprising a plurality of said ejector units, wherein the cover member has a plurality of said first openings corresponding to the ejector units, respectively, and wherein said at least one first adhering portion adheres, and thereby fixes, the ejector units and the cover member to each other, such that the nozzles of each one of the ejector units are positioned relative to the nozzles of the other ejector unit or units.

8. The ink jet printer head according to claim 1, wherein said at least one first adhering portion is formed of an ultraviolet-light sensitive adhesive which hardens upon exposure to an ultraviolet light.

9. The ink jet printer head according to claim 1, wherein said at least one second adhering portion is formed of an ultraviolet-light sensitive adhesive which hardens upon exposure to an ultraviolet light.

10. The ink jet printer head according to claim 1, wherein the sealing portion is formed of a sealing agent, and wherein the sealing agent comprises a silicone adhesive.

11. The ink jet printer head according to claim 1, wherein said at least one first adhering portion is continuously formed on respective exposed portions of said at least one ejector unit and the cover member.

12. The ink jet printer head according to claim 11, comprising a plurality of said first adhering portions which are formed in two arrays along widthwise opposite edge lines of said at least one ejector unit, such that each of the first adhering portions is continuously formed on the respective exposed portions of said at least one ejector unit and the cover member.

13. A method of producing an ink jet printer head including at least one ejector unit having, in one of opposite surfaces thereof, a plurality of nozzles each of which ejects a droplet of ink toward a recording medium, a cover member having at least one first opening, and a frame member including a bottom wall, the method comprising the steps of:

providing, between a first to-be-sealed portion of the one surface of said at least one ejector unit and a second to-be-sealed portion of the cover member, a sealing agent continuously along an entire periphery of said at least one first opening of the cover member, such that said at least one ejector unit and the cover member are sealed to each other, and such that the nozzles of said at least one ejector unit are exposed through said at least one first opening of the cover member, adhering and fixing, with a first adhesive, a first exposed edge portion of the other surface of said at least one ejector unit and a second exposed portion of the cover member that is different from the second to-be-sealed portion thereof and is adjacent to said first exposed edge portion of said at least one ejector unit, to each other, so as to provide a subassembly including said at least one ejector unit and the cover member, and adhering and fixing, with a second adhesive, the subassembly including said at least one ejector unit and the cover member, to the bottom wall of the frame member, so as to provide the ink jet printer head including the subassembly and the frame member.

14. The method according to claim 13, further comprising a step of preparing the frame member having at least one second opening which is formed through a thickness of the bottom wall thereof, wherein the step of adhering with the second adhesive comprises applying, through said at least one second opening of the frame member, the second adhesive to at least one portion of the subassembly.

15. The method according to claim 14, wherein the step of adhering with the first adhesive comprises adhering, with the first adhesive, said at least one ejector unit and the cover member to each other at at least one portion that is not aligned with said at least one second opening of the bottom wall of the frame member, in a reference direction perpendicular to the bottom wall of the frame member.

16. The method according to claim 13, wherein the first adhesive hardens more quickly than the sealing agent.

17. The method according to claim 13, wherein at least one of the first and second adhesives comprises an ultraviolet-light sensitive adhesive that hardens upon exposure to an ultraviolet light.

18. The method according to claim 13, wherein the sealing agent comprises a silicone adhesive.

19. The method according to claim 13, further comprising a step of preparing a plurality of said ejector units, and a step of preparing the cover member having a plurality of said first openings corresponding to the ejector units, respectively, and wherein the step of adhering with the first adhesive comprises adhering, with the first adhesive, the ejector units and the cover member to each other, such that the nozzles of each one of the ejector units are positioned relative to the nozzles of the other ejector unit or units.

20. The method according to claim 13, wherein the step of adhering with the first adhesive comprises continuously forming, with the first adhesive, at least one adhering portion on respective exposed portions of said at least one ejector unit and the cover member.

21. The method according to claim 13, further comprising preparing said at least one ejector unit having the plurality of nozzles arranged in at least one array, wherein the step of adhering with the first adhesive comprises forming, with the first adhesive, at least one first adhering portion along at least one reference line substantially parallel to said at least one array of nozzles, and wherein the step of adhering with the second adhesive comprises forming, with the second adhesive, at least one second adhering portion along said at least one reference line such that lengthwise opposite ends of said at least one second adhering portion are located inside lengthwise opposite ends of said at least one first adhering portion, respectively.

22. An ink jet printer head, comprising:

at least one ejector unit having, in one of opposite surfaces thereof, a plurality of nozzles each of which ejects a droplet of ink toward a recording medium;

a cover member which has at least one first opening and is fixed to said one surface of said at least one ejector unit such that the nozzles of said at least one ejector unit such that the nozzles of said at least one ejector unit are exposed through said at least one first opening;

a frame member including a bottom wall to which the other surface of said at least one ejector unit is fixed;

at least one sealing portion which seals a first to-be-sealed portion of the one surface of said at least one ejector unit and a second to-be-sealed portion of the cover member to each other continuously along an entire periphery of said at least one first opening of the cover member;

at least one first adhering portion which adheres to a first exposed edge portion of the other surface of said at least one ejector unit, and additionally adheres to a second exposed portion of the cover member that is different from the second to-be-sealed portion thereof and is adjacent to said first exposed edge portion of said at least one ejector unit, so as to fix said at least one ejector unit and the cover member to each other; and at least one second adhering portion which adheres to at least said at least one ejector unit, so as to fix the other surface of said at least one ejector unit to the bottom wall of the frame member, wherein said at least one second adhering portion is at least partially offset, in an off-set direction parallel to the bottom wall, from said at least one first adhering portion adhering to the first exposed edge portion of said at least one ejector unit and the second exposed portion of the cover member.

23. The ink jet printer head according to claim 22, wherein the ink-jet printer head includes a plurality of said first adhering portions which are distant from each other in the off-set direction, and said at least one second adhering portion is at least partially offset, in the off-set direction, from each of the first adhering portions.

24. The ink jet printer head according to claim 23, wherein the ink-jet printer head includes at least three said first adhering portions which are distant from each other in the off-set direction, and a plurality of said second adhering portions which are distant from each other in the off-set direction and each of which is at least partially offset, in the off-set direction, from each of the first adhering portions.

* * * * *